US010619978B1

(12) United States Patent
Ackley et al.

(10) Patent No.: US 10,619,978 B1
(45) Date of Patent: Apr. 14, 2020

(54) SHIELD APPARATUSES HAVING OFFENSIVE AND DEFENSIVE STRUCTURES

(71) Applicant: CASPER COO LLC, Houston, TX (US)

(72) Inventors: Stacy Ray Ackley, Pattison, TX (US); Glenn Plowman, Houston, TX (US); Stephen McNeill Robinson, Houston, TX (US)

(73) Assignee: Casper COO LLC, Houston, TX (US)

( * ) Notice: Subject to any disclaimer, the term of this patent is extended or adjusted under 35 U.S.C. 154(b) by 0 days.

(21) Appl. No.: 16/256,678

(22) Filed: Jan. 24, 2019

(51) Int. Cl.

| | |
|---|---|
| ***F41H 5/02*** | (2006.01) |
| ***F41H 5/08*** | (2006.01) |
| ***F41H 13/00*** | (2006.01) |
| *G08B 27/00* | (2006.01) |
| *F41H 5/04* | (2006.01) |

(52) U.S. Cl.
CPC ..... *F41H 5/02* (2013.01); *F41H 5/08* (2013.01); *F41H 13/0012* (2013.01); *F41H 5/04* (2013.01); *G08B 27/001* (2013.01)

(58) Field of Classification Search
CPC ..... F41H 5/02; F41H 5/08; F41H 5/04; F41H 13/0012; G08B 27/001
USPC ..... 89/36.01, 36.02, 36.03, 36.05, 36.07, 89/36.09; 2/2.5
See application file for complete search history.

(56) References Cited

U.S. PATENT DOCUMENTS 212,877 A 5/1879 Wellman
453,088 A * 5/1891 McMahon ..... F41H 5/14 89/36.09
5,862,882 A 1/1999 Brady et al.
6,367,363 B1 4/2002 Widmont
6,622,607 B1 * 9/2003 Miller ..... F41H 5/06 2/2.5
7,124,675 B1 10/2006 Sand
7,891,283 B2 * 2/2011 Kleniatis ..... F41H 5/14 89/36.09
7,980,166 B1 7/2011 Fuqua et al.
8,015,910 B1 * 9/2011 Fuqua ..... F41H 5/14 89/36.01
8,549,979 B2 * 10/2013 Spransy ..... F41H 5/013 89/36.07
8,646,372 B1 2/2014 Lee
8,726,782 B2 * 5/2014 White ..... F41H 5/14 89/36.09
9,010,230 B2 4/2015 Peters
9,010,231 B1 4/2015 Cohn et al.
9,310,170 B1 4/2016 Basewitz
9,347,748 B1 * 5/2016 Crisp ..... F41H 5/08
9,448,041 B2 * 9/2016 Gonda ..... F41H 5/14
2009/0067923 A1 3/2009 Whitford
(Continued)

FOREIGN PATENT DOCUMENTS

WO 2008054405 A2 5/2008
WO 2009131727 A2 10/2009

*Primary Examiner* — John Cooper
(74) *Attorney, Agent, or Firm* — Robert W. Strozier

(57) ABSTRACT

Ballistic shields having a convex configuration including a middle section and forward angled left side and right side wings. The shields may also include at least three manual or electro-mechanical roller units, transparent windows or display devices with cameras or other motions sensors, and spikes, electro-shock devices, or non-lethal incapacitating devices.

21 Claims, 25 Drawing Sheets

(56) References Cited

U.S. PATENT DOCUMENTS

| | | | | |
|---|---|---|---|---|
| 2010/0083820 | A1* | 4/2010 | Doyner | F41H 5/08 89/36.02 |
| 2010/0290833 | A1 | 11/2010 | Whitford | |
| 2012/0168702 | A1 | 7/2012 | Fromm | |
| 2015/0033990 | A1 | 2/2015 | Yeager | |
| 2016/0003583 | A1 | 1/2016 | Harwood et al. | |
| 2016/0061569 | A1 | 3/2016 | Fernandez | |

* cited by examiner

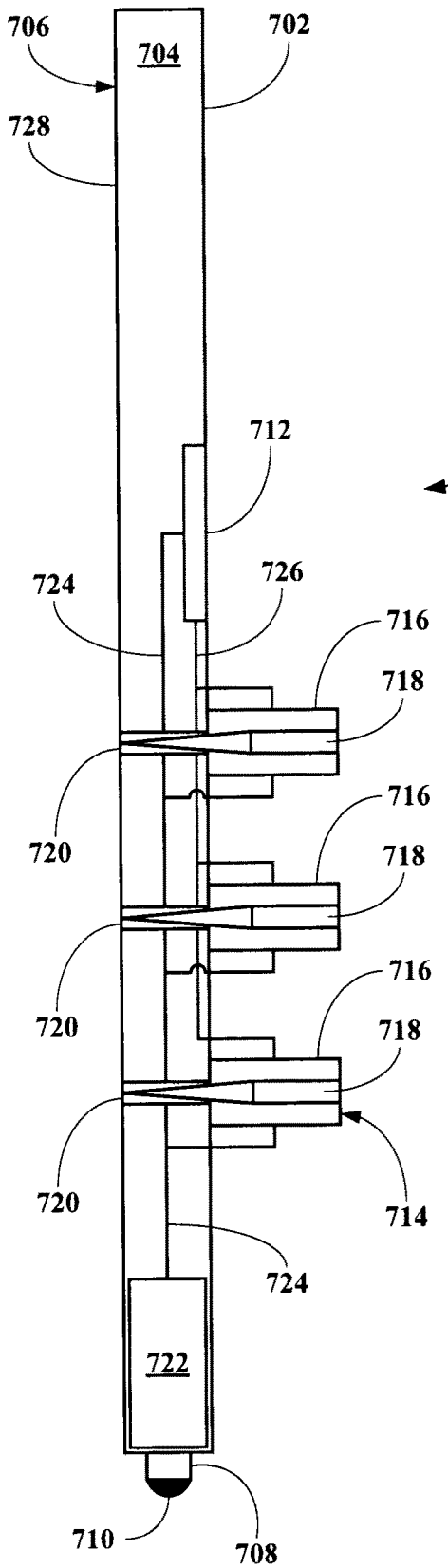
FIG. 7A
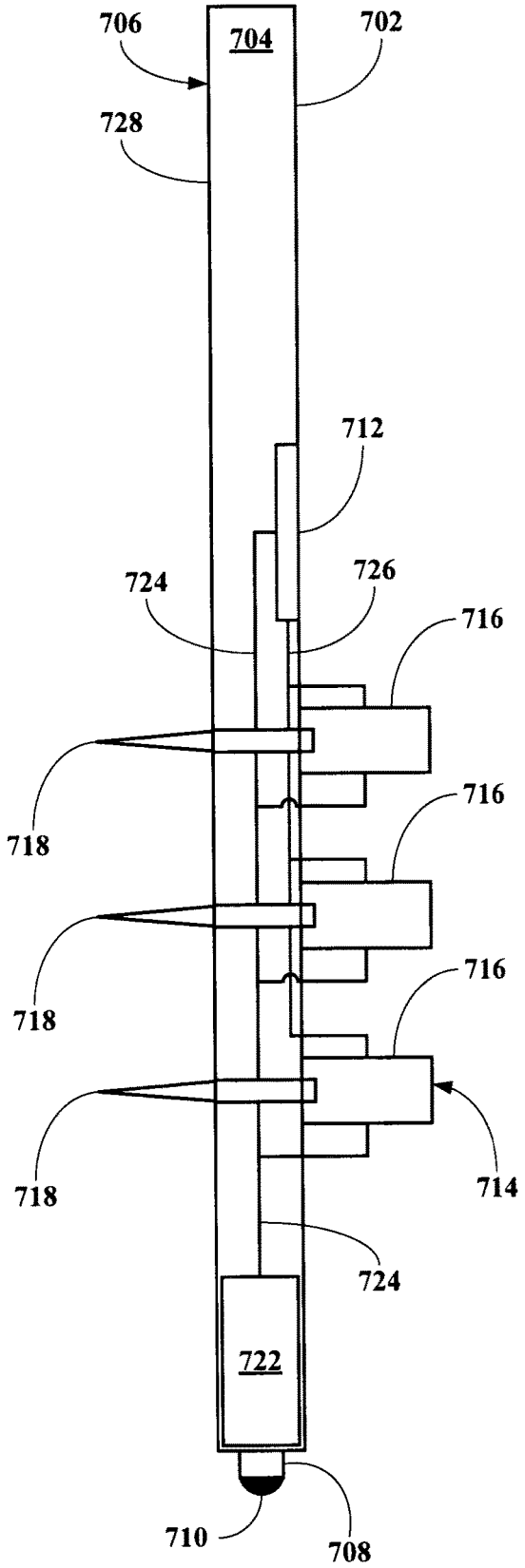
FIG. 7B
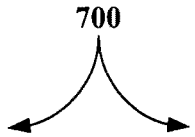

Figure 11:
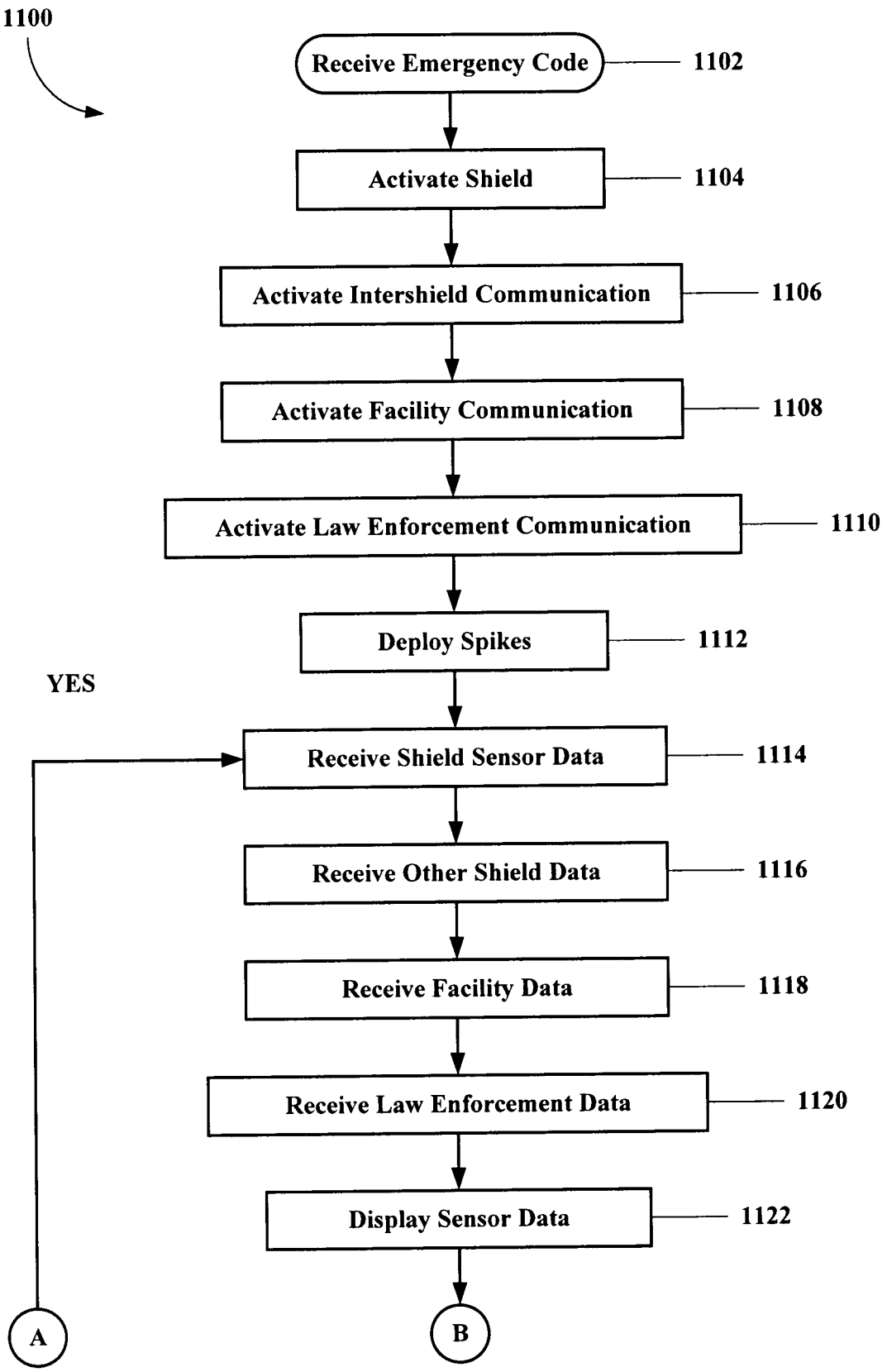

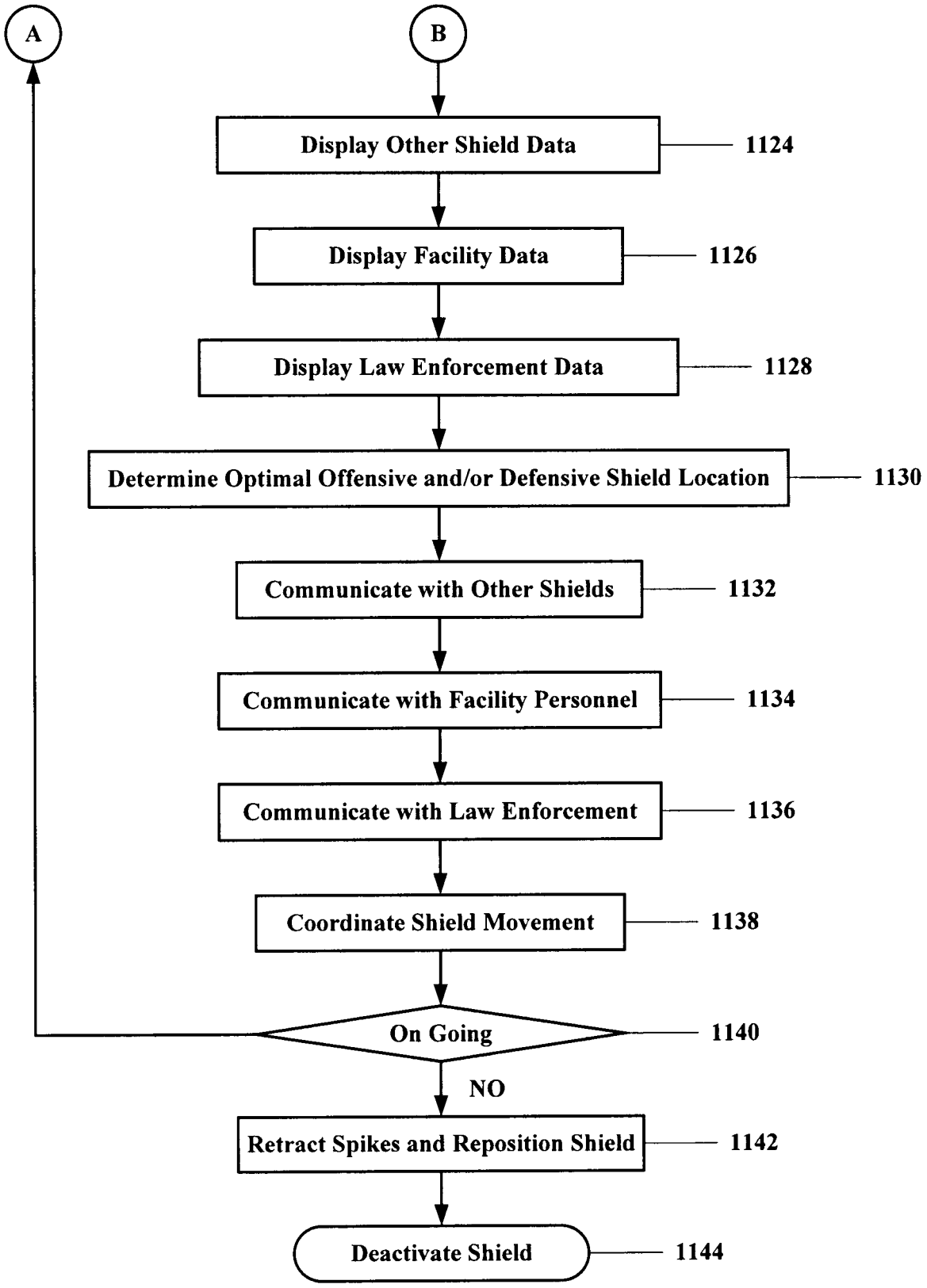
FIG. 11 - Cont'd

SHIELD APPARATUSES HAVING OFFENSIVE AND DEFENSIVE STRUCTURES

RELATED APPLICATIONS

No related applications.

BACKGROUND OF THE DISCLOSURE

1. Field of the Disclosure

Embodiments of the present disclosure relate to shield apparatuses having offensive and defensive structures and methods for making and using same.

In particular, embodiments of the present disclosure relate to shield apparatuses having offensive and defensive structures and methods for making and using same, wherein the shield apparatuses include a ballistic defensive shield assembly, a handle assembly, a moving or locomotion assembly, and an offensive assembly.

2. Description of the Related Art

Due to rash of school related shootings and the lack of adequate tools for the protection of students, faculty and administration personnel, there is still a need in the art for shielding devices that are capable of defense and offense in active shooter scenarios.

SUMMARY OF THE DISCLOSURE

Embodiments of this disclosure provide apparatuses including a ballistic defensive shield assembly, a handle assembly, a locomotion assembly, an offensive assembly, and a monitoring/visualization assembly. The ballistic shield assembly includes a right front angled side or wing, a straight center portion, and a left front angled side or wing. In certain embodiment, the shields may also include right and left back angled sides or wings. The handle assembly includes a plurality of handle configured to move the shield forward, backward, and/or from side to side and to turn or rotate the shield to the right or left for offensive use. The handles are positioned for different user heights and arm span. The moving or locomotion assembly includes at least three housings, each of the housings including an omnidirectional rotatable member, where the three housings are affixed to the bottom of the shield in a three point stand configuration for maximum stability. The offensive assembly includes a plurality of pikes and optionally a pike deployment assembly. The monitoring/visualization includes a transparent ballistic window or a plurality of cameras or cameras and motion sensors, a processing unit and a display unit disposed on the inner surface of the shield. The shield is constructed out of ballistic armor or ballistic material capable of deflecting or absorbing bullets from single shot handheld firearms, semi-automatic firearms, and/or automatic firearms. The defensive capability of the shields includes the shield itself, the monitoring/visualization assembly, and the locomotion assembly, where the ballistic nature of the shield, the center and sides form a defensive zone so that people positioned behind the shield are protected from bullets. The offensive capability of the shields include the sides that may be used to impact the shooter and the pikes that may be used to inflict bodily damage to the shooter by moving the shield at the shooter. Additionally, the offensive capability may include a curvature of the shield or a configuration of the sides or wings and center or middle section to focus impinging bullets ricochet back towards the shooter and away from innocents that may be positioned behind the shield or at least behind the angle of the front angled shield sides or wings. In other embodiments, the shields also include locking devices of securing the shield to a wall in the facility to secure the shield to a wall or in a shield housing unit. In certain embodiments, the locking devices may magnetic and the locks may be opened biometrically such a figure print scanner or palm scanner so that the shield may only be used by authorized personnel. The locking systems may also be voice activated, where the locks only recognize certain individuals. In certain embodiments, the user must utter a specific phrase. In other embodiments, the locks may be locked or unlocked by biometric (finger or palm scanners) and voice.

Embodiments of this disclosure provide methods for making the shield apparatuses of this invention including the steps of selecting the materials out of which the shield will be constructed. The methods also involve attaching or affixing the locomotion units to the bottom of shield in a triangular configures to allow movement of the shield, while maintaining maximum stability. The methods also involve adding a processing unit, sensors, camera and display for those shield that include electronics. The methods also include affixing spikes to the shield. The methods may also include installing solenoid, worm drives or other electromechanical devices that are capable of automatic spike deployment and retraction. The methods may also include installing manual spike deployment assemblies for manual spike deployment. In other embodiments, the manual spike deployment assemblies may include mechanisms that use lever arms to deploy and retract the spikes. In other embodiments, the manual spike deployment assemblies may include mechanisms that use spring loaded assemblies.

Embodiments of this disclosure provide methods ofusing electronic shields of this invention including a receive an emergency code step, where a shield of this disclosure equipped with a processing unit and a display. The emergency code may be transmitted from a facility or from law enforcement or other emergency services. Once the emergency code is received by the shield, the methods activate the shield in an activate shield step. The activation step includes activating inter-shield communication in an activate inter-shield communication step. The activation step also includes activating facility communication in an activate facility communication step and activating law enforcement communication in an activate law enforcement communication step. Once all of the communication links have been activated and established, the methods may include the step of deploying the spikes in a deploy spikes step, which may be a manual deployment or an electronic deployment depending on the nature of the shield. Additionally, the deploy spikes step may occur at any time depending on situation. It is depicted here as it is part of the activation steps. After activation and potential spike deployment, the methods includes configuring the processing unit to receive data. The first receive step involves receiving data from shield sensors such as cameras, motion sensors, thermal sensors, IR sensors, etc. in a receive shield sensor data step. The methods also include receiving other shield data in a receive other shield data step. The methods also include receiving facility data in a receive facility data step. The methods also include receiving law enforcement data in a receive law enforcement data step. It should be recognized that the methods may receive data from any, some, or all of these sources on a continuous, periodic, semi-periodic, and/or intermittent basis for the duration of an emergency situation. After receipt of any, some or all of the data, the methods also include configuring the processing unit to send the data in a readable or image based format to the display device. The methods may include displaying the sensor data in a sensor data window on the display in display sensor data step. The methods include displaying the other shield data in a other shield data window on the display in display other shield data step. The methods include displaying the facility data in a facility data window on the display in display facility data step. The methods include displaying the law enforcement data in a facility data window on the display in display law enforcement data step. The methods also include configuring the processing unit to process the data, any, some, or all of the data, to determine an optimal location for the shield from both an offensive and defensive perspective in a determine optimal offensive and/or defensive shield location step. The methods also includes configuring the processing unit to communicate with other shields in a communication with other shields step. The methods also include configuring the processing unit to communicate with facility personnel in a communication with facility personnel step. The methods also include configuring the processing unit to communicate with law enforcement in a communication with law enforcement step. The methods also include configuring the processing unit to coordinate shield movement with law enforcement and/or other shields based on the dynamics of the situation in a coordinate shield movement step. The methods also include configuring the processing unit to determine whether the situation is ongoing in an ongoing conditional step. The determination may be the receipt of a stand down order from law enforcement, from facility personnel or from other data. If the situation is ongoing, then control is transferred along a YES branch through the circle A to receive shield sensor data step. If the situation is not ongoing or has been resolved, the control is transferred along a NO branch to a retract spikes and reposition shield step. The methods then include the step of deactivating the shield in a deactivate shield step.

BRIEF DESCRIPTION OF THE DRAWINGS OF THE DISCLOSURE

The disclosure may be better understood with reference to the following detailed description together with the appended illustrative drawings in which like elements are numbered the same:

FIGS. 1A-D depicts a front plan view, a rear plan view, a top plan view, and a bottom plan view of an embodiment of a shield apparatus of this invention having straight wings.

Figure 1A:
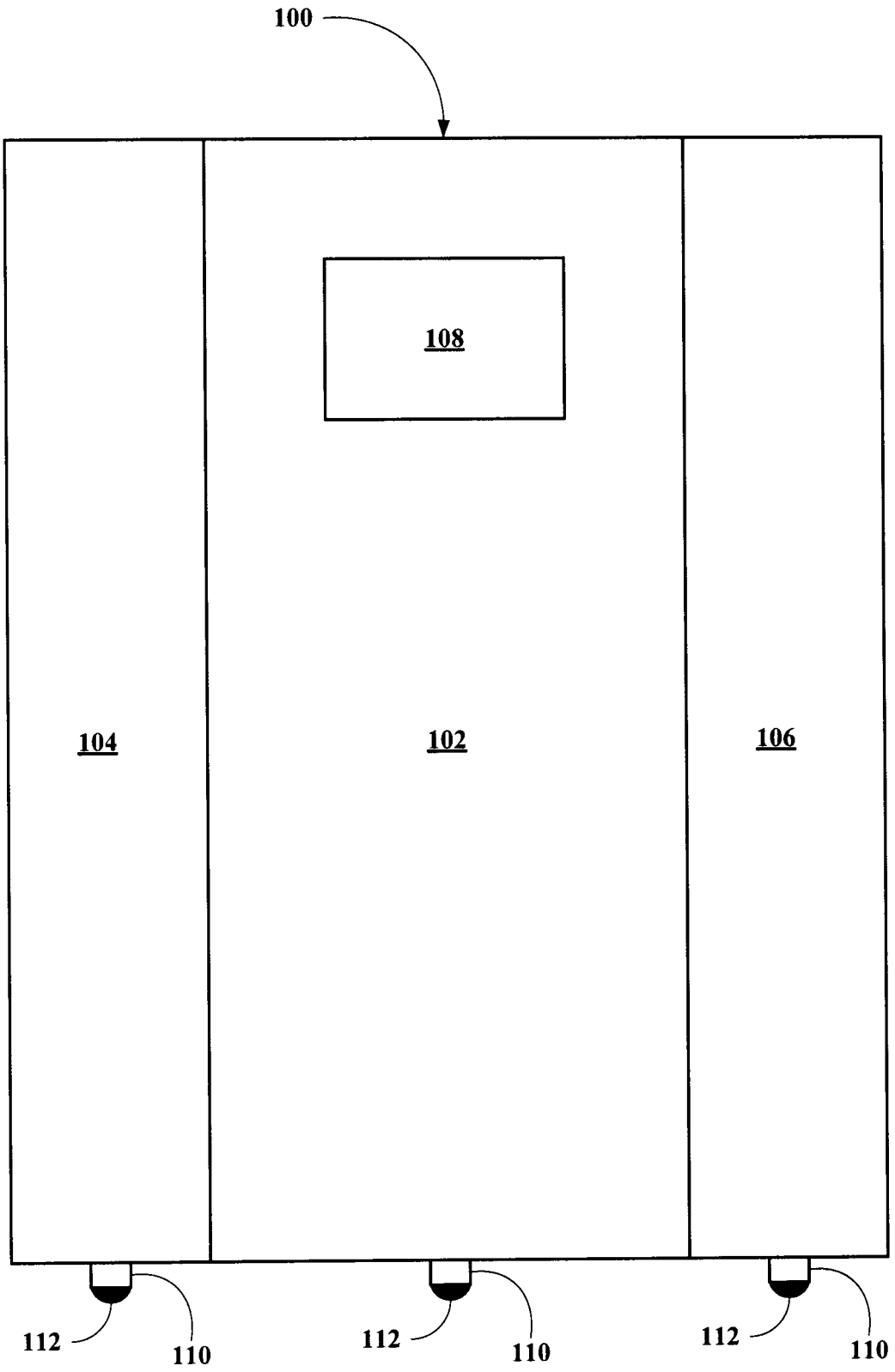
Figure 1B:
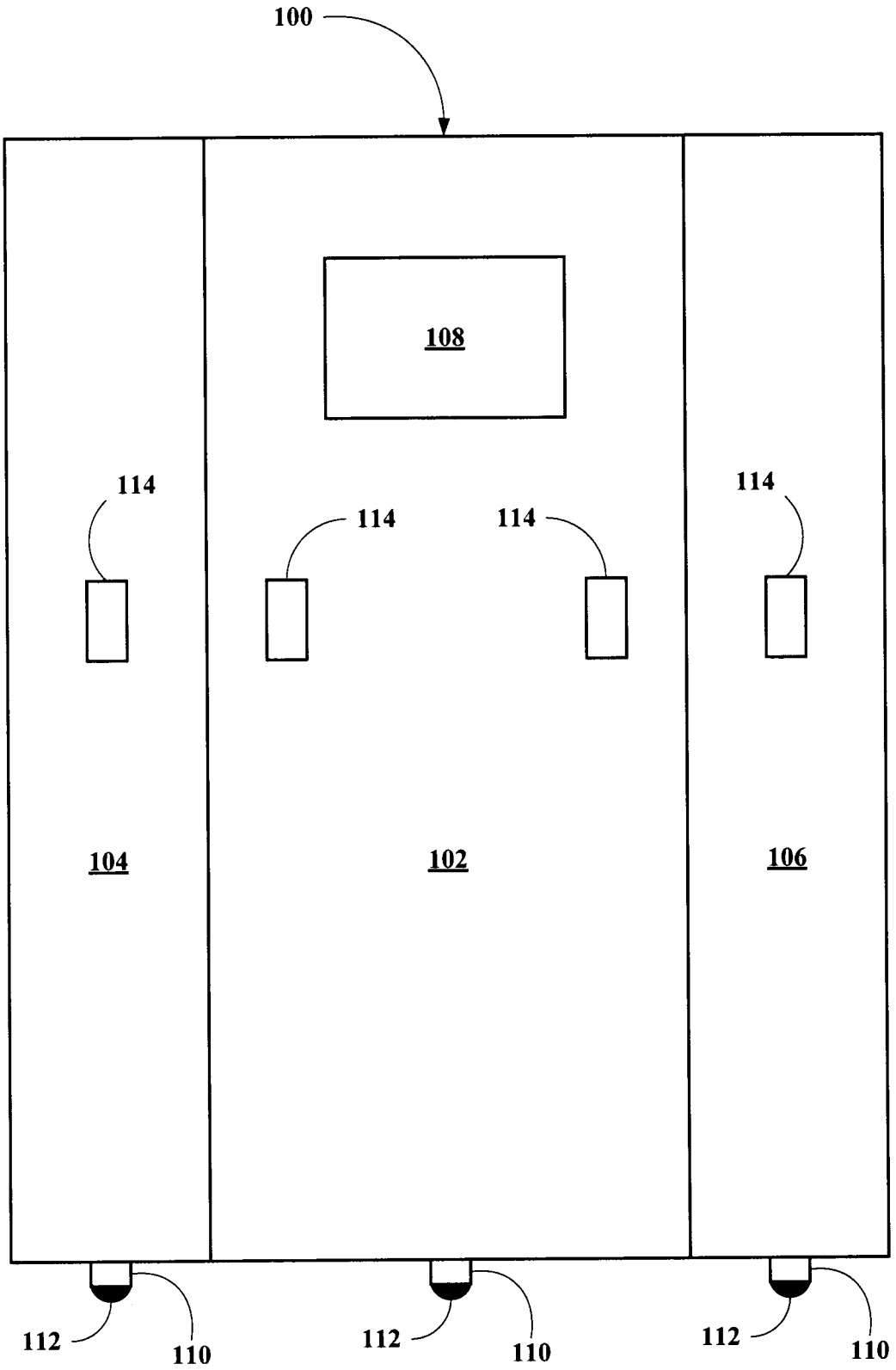
Figure 1C:
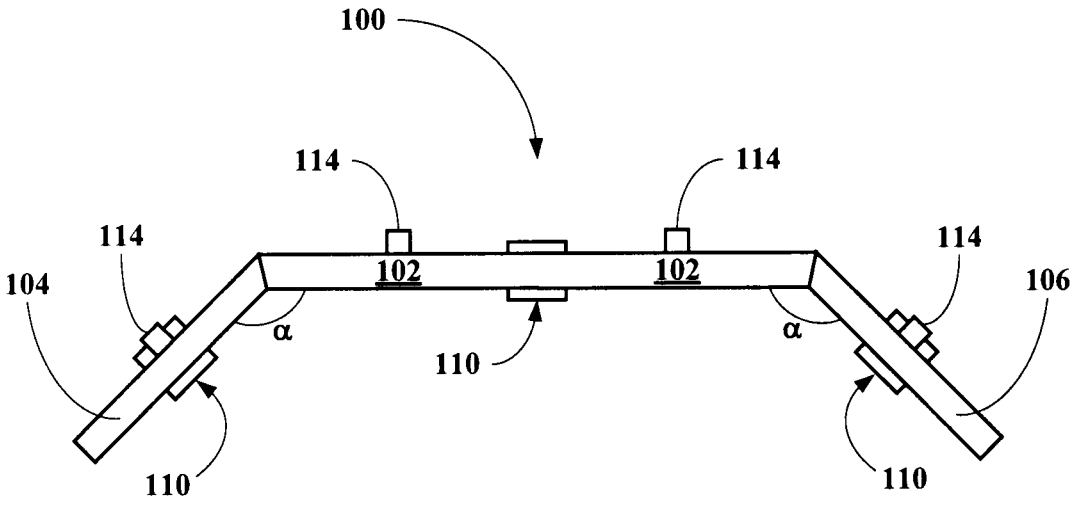
Figure 1D:
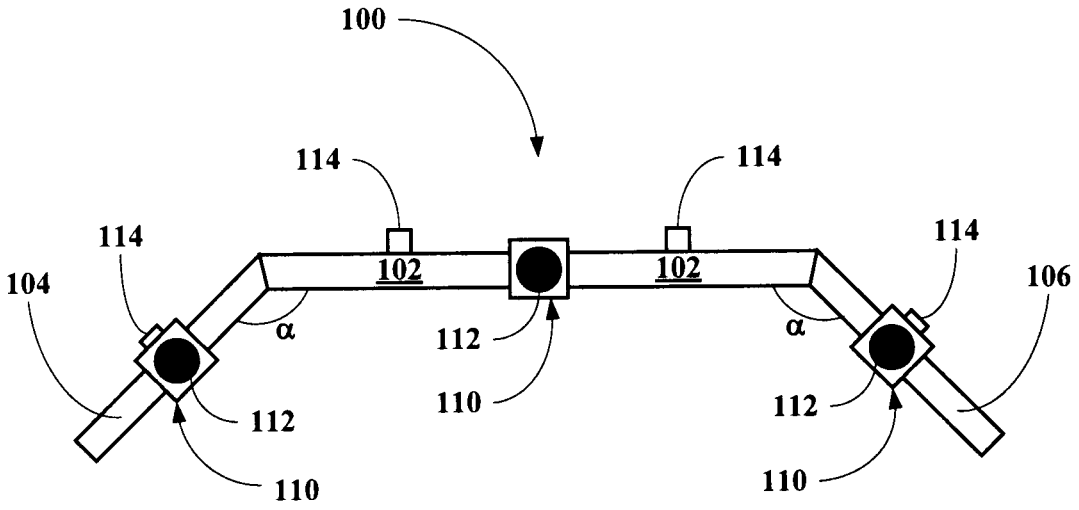
Figure 1E:
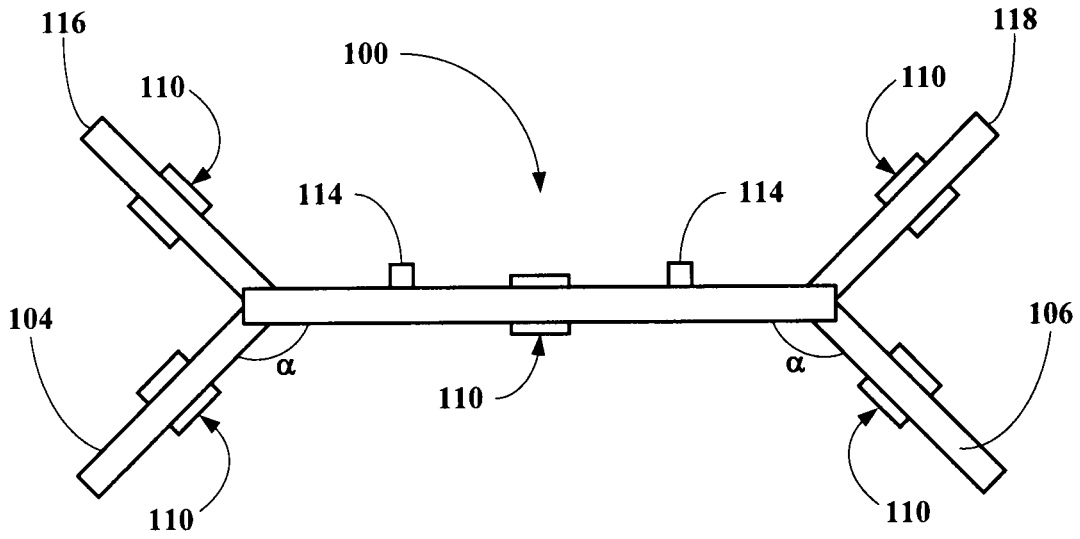
Figure 1F:
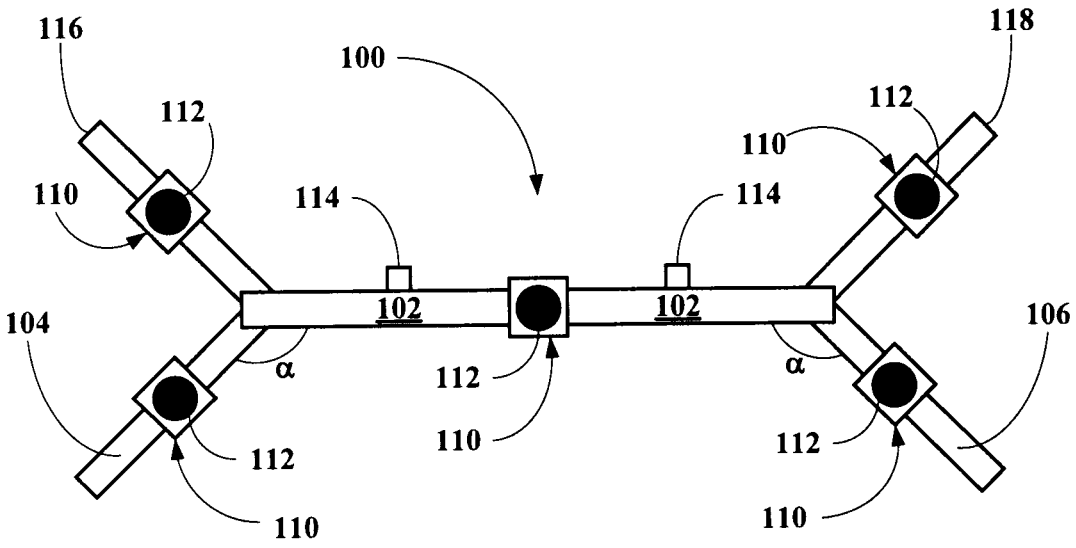

FIGS. 1E&F depicts a top plan view and a bottom plan view of an embodiment of a shield apparatus of this invention having straight forward and backward wings.

Figure 1G:
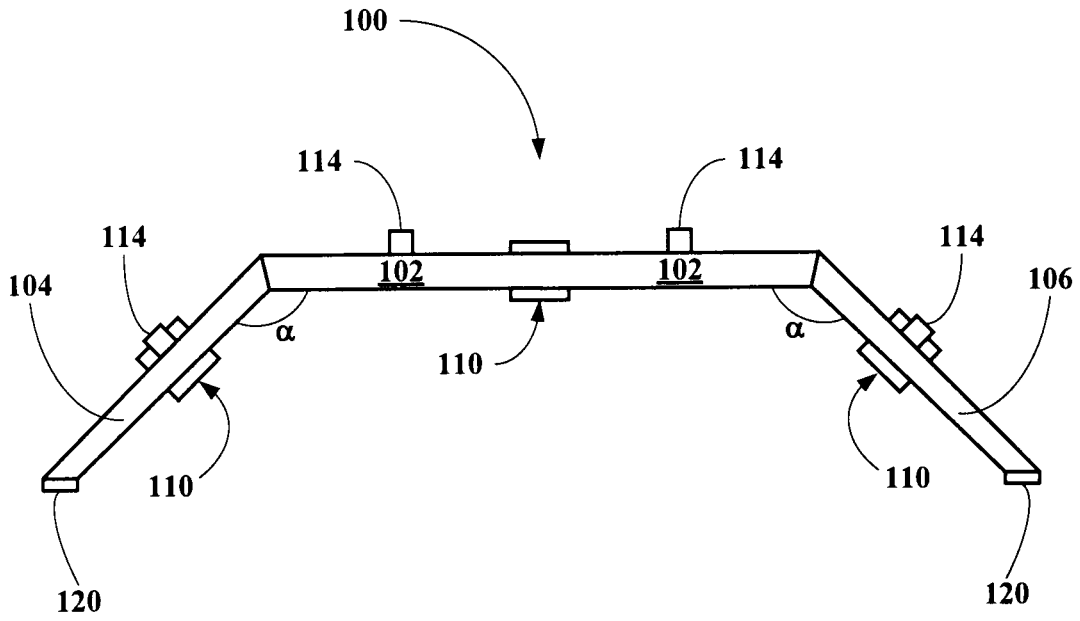
Figure 1H:
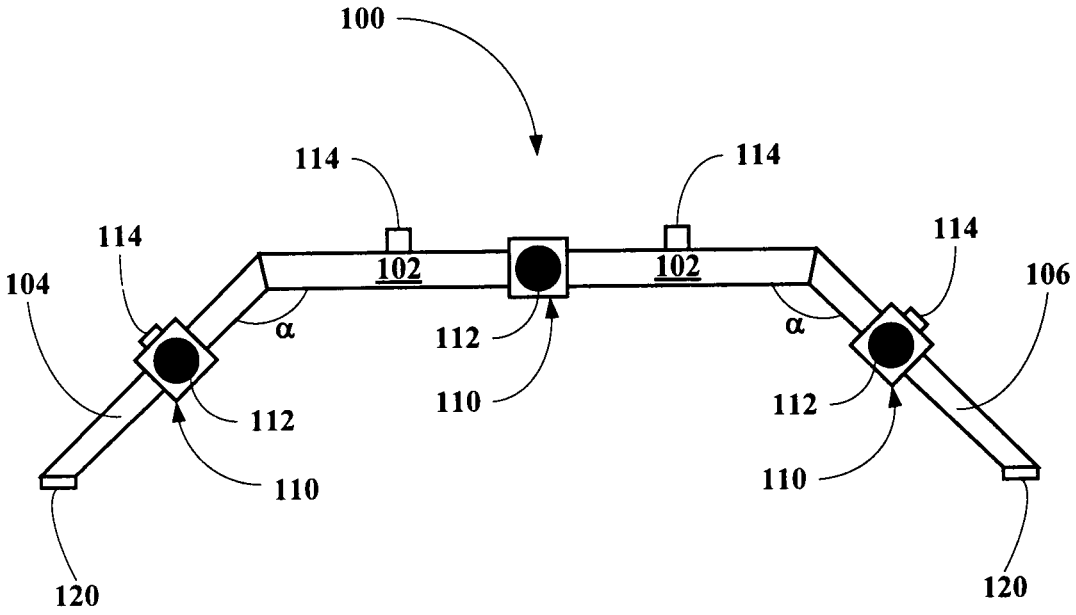

FIGS. 1G&H depicts a top plan view and a bottom plan view of an embodiment of a shield apparatus of this invention having straight wings and wall mount engaging members.

Figure 1I:
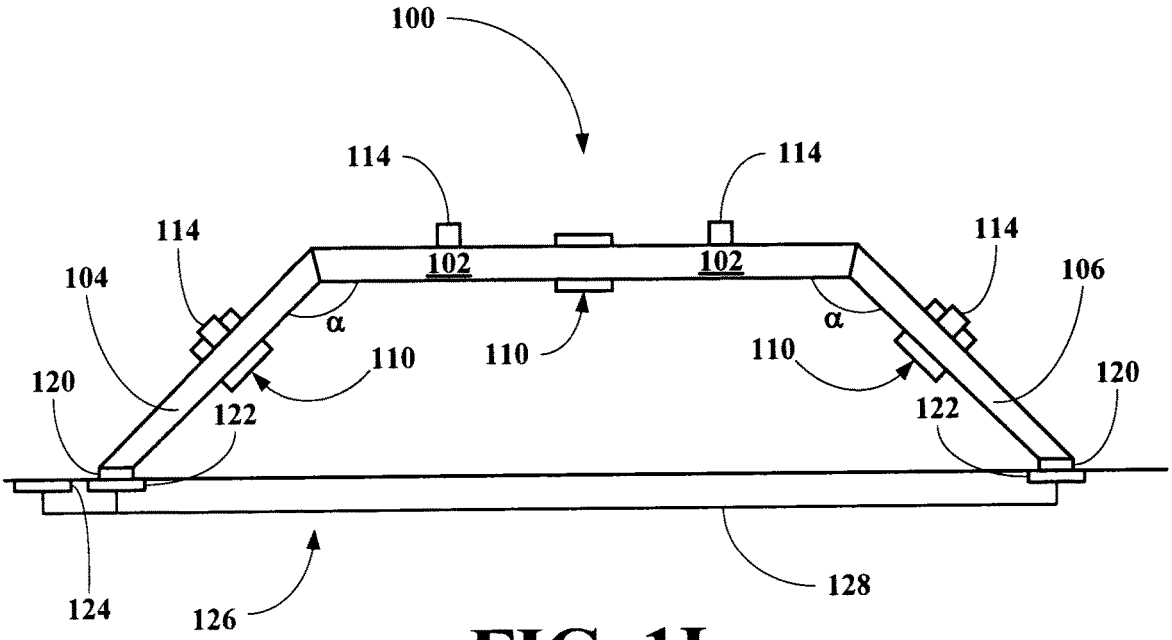
Figure 1J:
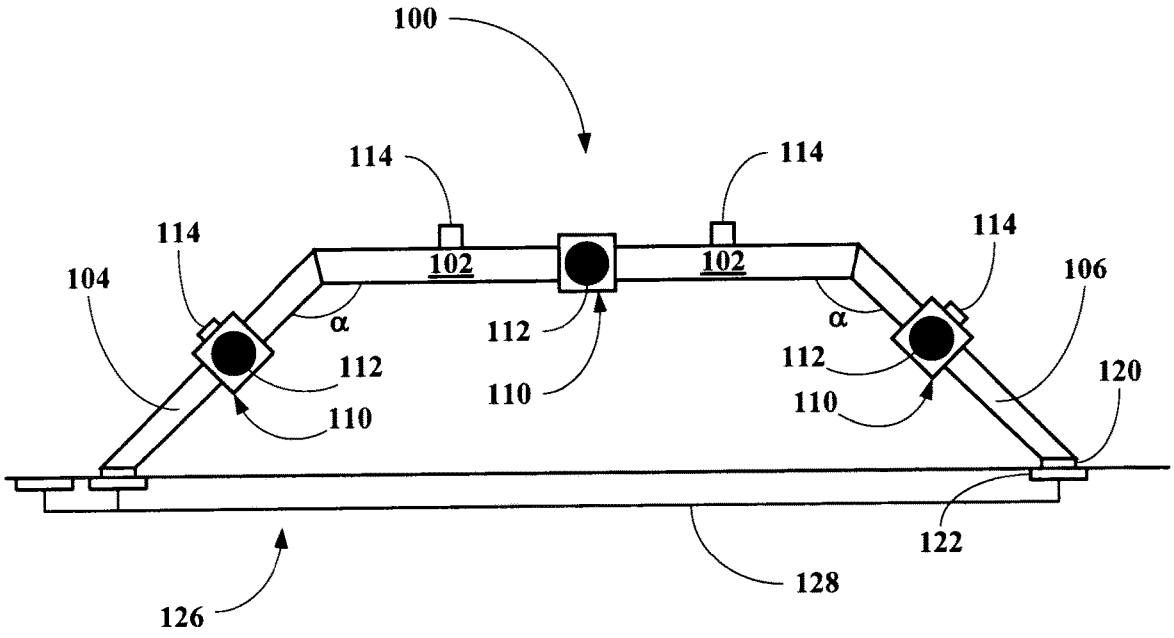

FIGS. 1I&J depicts a top plan view and a bottom plan view of an embodiment of a shield apparatus of this invention having straight wings and wall mount engaging members mounted to a wall with biometric lock.

FIGS. 2A-F depict a front plan view, a rear plan view, a top plan view, and a bottom plan view of another embodiment of a shield apparatus of this invention having either continuously curved shield or straight middle section and curved wings.

Figure 3A:
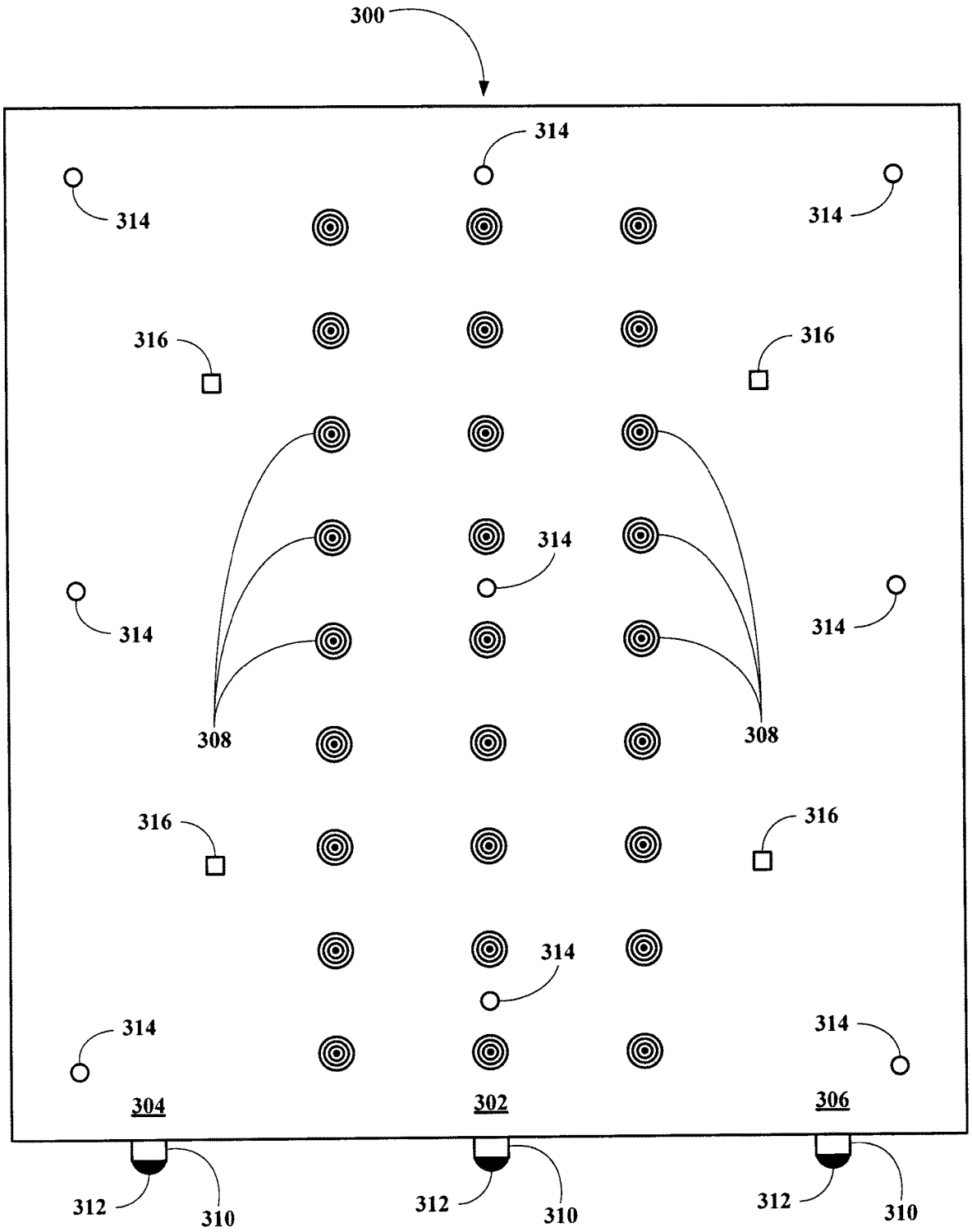

FIGS. 3A&B depict a front plan view and a rear plan view of another embodiment of a shield apparatus of this invention having a display, a processing unit, a power supply, cameras, motion sensors, wireless communication hardware, a microphone, and a speaker.

Figure 4A:
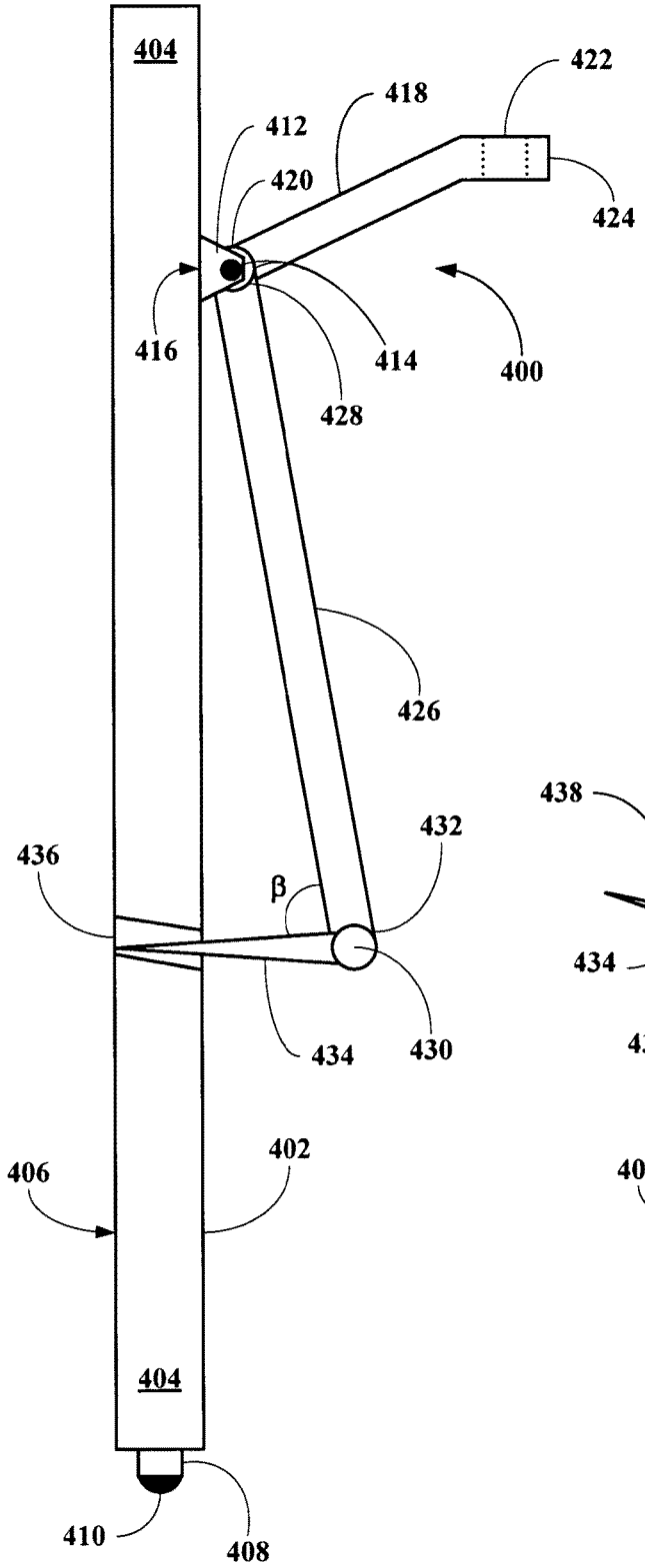
Figure 4B:
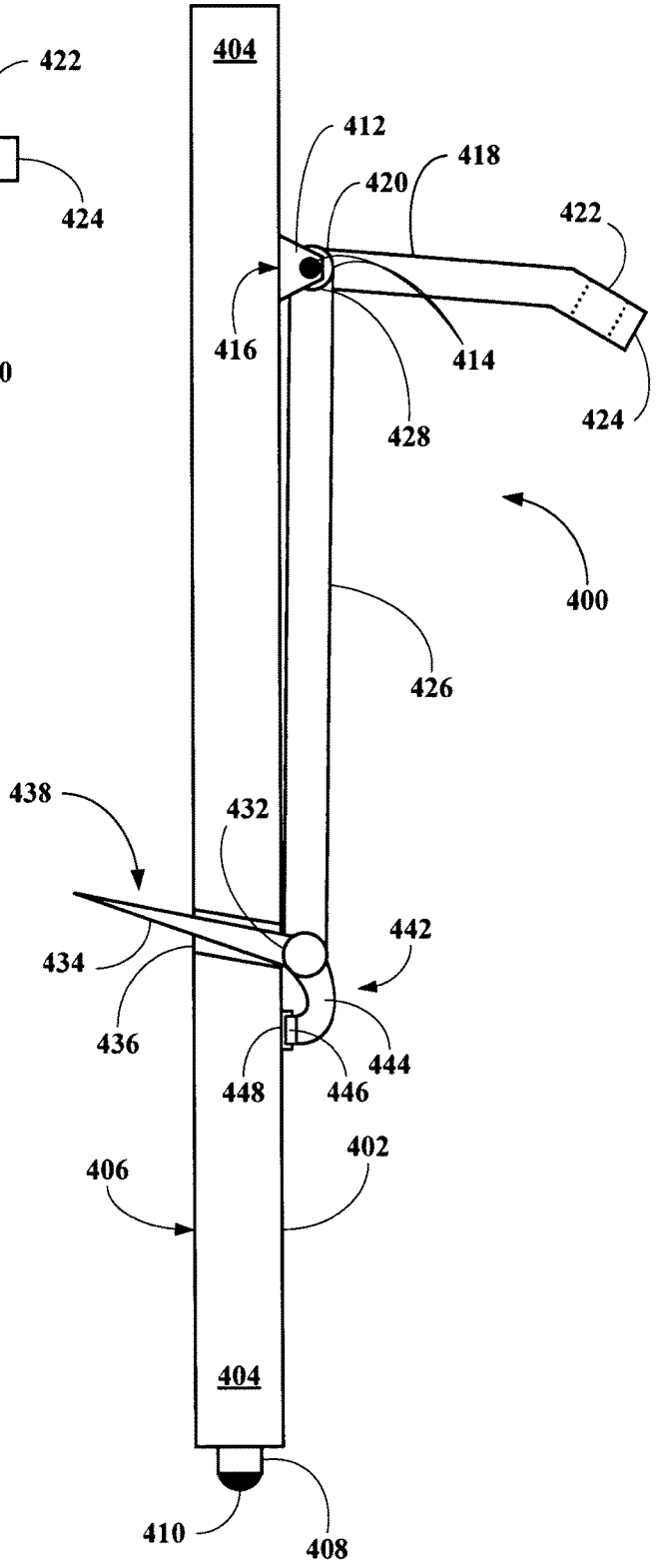

FIGS. 4A&B depict an embodiment of a manual spike deployment assembly having a lever arm in retracted and deployed states.

FIGS. 5A-E depict another embodiment of a manual spike deployment assembly having a lever arm.

FIGS. 6A-D depict an embodiment of a spring loaded manual spike deployment assembly having key pins or key pin rod in retracted and deployed states.

FIGS. 7A&B depict an embodiment of a solenoid spike deployment assembly.

Figure 8A:
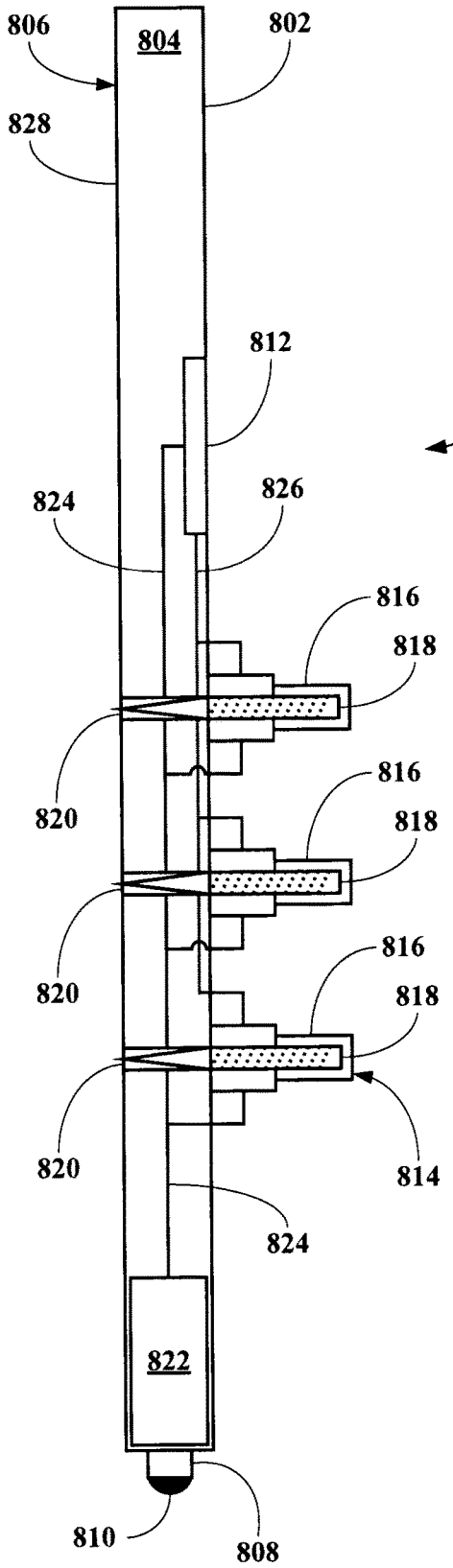

FIGS. 8A&B depict an embodiment of a worm drive spike deployment assembly.

Figure 9:
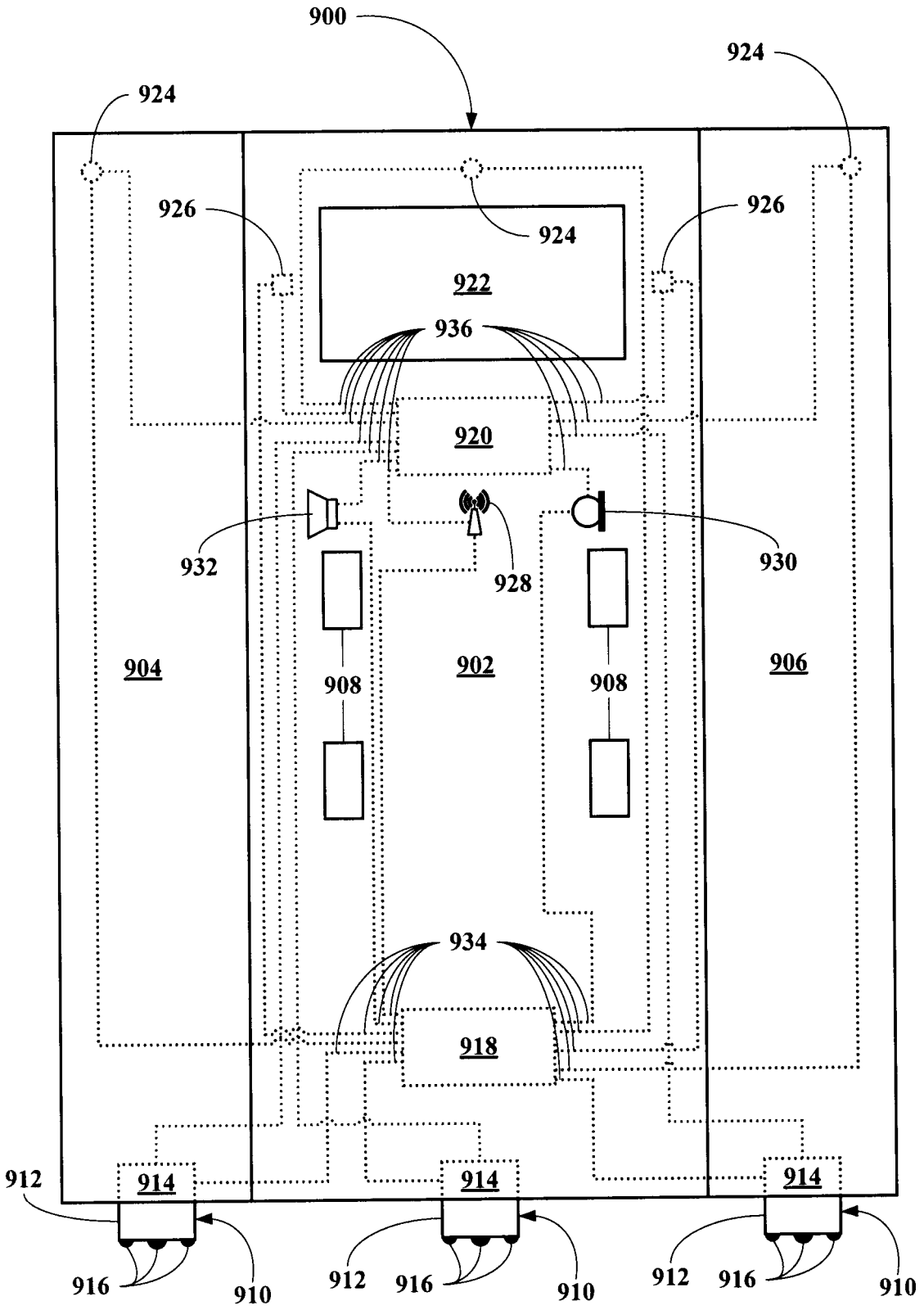

FIG. 9 depicts back plan view of a shield having three motorized roller assemblies, handles, a display, a processing unit, a power supply, cameras, non-lethal electro-shock units, wireless communication hardware, a microphone, and a speaker.

FIGS. 10A-D depict single layer and multilayer shield ballistic shield constructs.

FIG. 11 depict an embodiment of using a ballistic shield of this disclosure.

DEFINITIONS USED IN THE DISCLOSURE

The term "at least one" means one or more or one or a plurality, additionally, these three terms may be used interchangeably within this application. For example, at least one device means one or more devices or one device and a plurality of devices.

The term "one or a plurality" means one item or a plurality of items.

The term "about" means that a value of a given quantity is within ±20% of the stated value. In other embodiments, the value is within ±15% of the stated value. In other embodiments, the value is within ±10% of the stated value. In other embodiments, the value is within ±5% of the stated value. In other embodiments, the value is within ±2.5% of the stated value. In other embodiments, the value is within ±1% of the stated value.

The term "substantially" means that a value of a given quantity is within ±5% of the stated value. In other embodiments, the value is within ±2.5% of the stated value. In other embodiments, the value is within ±2% of the stated value. In other embodiments, the value is within ±1% of the stated value. In other embodiments, the value is within ±0.1% of the stated value.

DETAILED DESCRIPTION OF THE DISCLOSURE

The inventors have found that ballistic shield apparatuses may be constructed with both defensive and offensive capabilities for active shooter situations. The shield apparatuses having a convex configuration including either a single convex curvilinear member or a straight or substantially straight center portion and two front angled side or wing portions. The side or wing portions are configured to provide offensive capabilities to the shield apparatuses so that the shield apparatuses may be rotated to contact an active shooter or an intruder. The shield apparatuses may also be equipped with a plurality of outward extending spikes configured to provide additional offensive capability to the shield apparatuses so that the spikes may be used to impart injury to the active shooter or intruder. The angled shield apparatuses include at least three housings, each housing including an omnidirectional rotatable member disposed on the bottom of the shield apparatuses and configured to form a three-point configuration to afford maximum stability to the shields in a stationary state or in a moving state. The shield apparatuses also include tilting stops deployed on the front and back surfaces to prevent the shield apparatuses from toppling over in a stationary state or a moving state. The stops may include a low friction layer so that the shield apparatuses may move forward, backward, side to side or rotate without significantly impeding motion in these directions. The defensive capability of the shield apparatuses include the ballistic armor out of which the shields are constructed, a monitoring/visualization assembly that allowed with user to see or detect the active shooter, and a locomotion assembly for moving the shield apparatuses forward, backward, side to side, or to rotate the shield, all of these motions to afford maximum shielding. The offensive capability of the shield apparatuses include the locomotion assembly, the monitoring/visualization assembly, the wings and the spikes. The locomotion assembly and the visualization assembly afford the user the ability to move the shield toward the active shooter, while maintaining maximal shielding. The wings and spikes are configured so that the wings may be used to contact the active shooter by rotating the shield to the left or right depending on where the active shooter is relative to the shield. The spikes may then impale or inflict bodily injury to the active shooter to dissuade or impair the shooter/intruders progress or ability to continue the assault. In certain embodiments, the spikes may be retractable or extendable either manually or automatically. In other embodiments, the monitoring/visualization assembly includes: (a) a power supply, (b) a processing unit having a user interface, memory, an operating system, communication hardware and software, and mass storage device, (c) a display device, and (d) a plurality of cameras or a plurality of cameras and motion sensors, wherein the power supply supplies power to the processing unit, the display device, and the cameras and sensors if present and wherein the processing unit or processor is in two way communication with the display device and the cameras and sensors if present.

Embodiments of this disclosure broadly relate to shield apparatuses include a ballistic defensive shield assembly, a handle assembly, a locomotion assembly, an offensive assembly, and a monitoring/visualization assembly.

The ballistic defensive shield assembly includes a single ballistic layer comprising a material capable of stopping or deflecting a bullet impacting a front surface of the layer. In other embodiments, the ballistic defensive shield assembly includes a plurality of layers, wherein the plurality of layers includes an outer ballistic absorbing layer capable of absorbing a bullets impact without causing the bullet to ricochet and an inner layer comprising a material capable of stopping the absorbed bullet. The outer ballistic absorbing layer may comprise a plurality of layers of different ballistic materials and thickness to stop and trap a bullet therein.

The handle assembly includes a plurality of handles in horizontal and vertical pattern including at least two rows of handles positioned to accommodate different user heights and weights. The handles may be padded or unpadded.

The locomotion assembly includes at least three roller units including an omnidirectional roller housing and an omnidirectional roller member, where the omnidirectional roller units permit motion in any direction. The roller units may be manually operated or may be motorized with motion sensors to determine which direction a user intends to move and using the motors to move or assist in the movement of the shield.

The offensive assembly includes the wings and spikes. The offensive assembly may also include shield mounted electro-shock such as a TASER® unit or similar electro-shock non-lethal weapon.

The monitoring/visualization assembly include motions sensors, cameras, thermal sensors, IR sensors, IR cameras, thermal imaging devices, or any other sensor that may be used to determine the location and movement of a potential assailant or active shooter.

In certain embodiments, the shield apparatuses comprise a convex configuration. In other embodiments, the convex configuration comprises a single convex curvilinear member. In other embodiments, the convex configuration comprises a straight or substantially straight center portion and two front angled side or wing portions. In other embodiments, the convex configuration comprises a single straight middle section and to straight wing section angled forward.

Embodiments of this disclosure broadly relate to movable ballistic shield apparatuses including: (a) a body including a middle section, a forward facing left wing, and a forward facing right wing so that the body has a convex configuration; (b) a plurality of spikes or spike deployment assemblies; (c) a plurality of handles disposed in the middle section or in the middle section and the wings; (d) at least three omnidirectional roller assemblies; and (e) a monitoring assembly, wherein the middle and wings are constructed out of a ballistic material capable of stopping and/or deflecting a bullet.

In certain embodiments, the middle section and the wings are straight and the wings are forward angled at a first angle relative to the middle section. In other embodiments, the monitoring assembly includes at least one transparent member disposed in the middle section, wherein the transparent member is made of a transparent ballistic material. In other embodiments, the monitoring assembly includes a power supply, a processing unit, a display device, cameras, sensors, at least one non-lethal electroshock unit, at least one wireless transmitter and receiver, the at least one microphone, and the at least one speaker, the power supply provides power to the other components via wires, and the processing unit communications and controls the other components via wires or via wireless communication.

In other embodiments, the spike deployment assemblies are either manual or automatic. In other embodiments, each of the manual spike deployment assemblies include a lever arm and a spike deployment arm including a plurality of spikes, and the middle section includes a plurality of apertures through which the spikes traverse in transitions between a retracted state and a deployed state. In other embodiments, each of the manual spike deployment assemblies include a spring, a stop, and a release key pin, and the middle section includes a plurality of apertures through which the spikes traverse in transitions between a retracted state and a deployed state. In other embodiments, each of the automatic spike deployment assemblies includes a solenoid and a spike, and the middle section includes a plurality of apertures through which the spikes traverse in transitions between a retracted state and a deployed state.

In other embodiments, each of the automatic spike deployment assemblies includes a worm drive and a threaded spike, and the middle section includes a plurality of apertures through which the spikes traverse in transitions between a retracted state and a deployed state. In other embodiments, the omnidirectional roller assemblies are either manual or motorized. In other embodiments, the wings, the spikes, and the one non-lethal electroshock unit provide an offensive capability of the apparatus, and the middle section, the wings, the monitoring assembly provide the defensive capability of the apparatus. In other embodiments, the body further includes a backward facing left wing and a backward facing right wing, wherein the backward facing left wing and the backward facing right wing are made of a ballistic material. In other embodiments, the convex configuration is configured to focus bullet ricochets in a direction of the shots striking the front surface of the apparatus.

Embodiments of this disclosure broadly relate to movable ballistic shield apparatus including: (a) a body including a middle section, a forward facing left wing, and a forward facing right wing so that the body has a convex configuration; (b) a plurality of automatic spike deployment assemblies; (c) a plurality of handles disposed in the middle section or in the middle section and the wings; (d) at least three omnidirectional roller assemblies; and (e) a monitoring assembly including a power supply, a processing unit, a display device, cameras, sensors, at least one non-lethal electroshock unit, at least one wireless transmitter and receiver, the at least one microphone, and the at least one speaker, wherein the power supply provides power to the other components via wires and the processing unit communications and controls the other components via wires or via wireless communication, wherein the middle and wings are constructed out of a ballistic material capable of stopping and/or deflecting a bullet.

In certain embodiments, each of the automatic spike deployment assemblies includes a solenoid and a spike, and the middle section includes a plurality of apertures through which the spikes traverse in transitions between a retracted state and a deployed state. In other embodiments, each of the automatic spike deployment assemblies includes a worm drive and a threaded spike, and the middle section includes a plurality of apertures through which the spikes traverse in transitions between a retracted state and a deployed state. In other embodiments, the omnidirectional roller assemblies are either manual or motorized. In other embodiments, the wings, the spikes, and the one non-lethal electroshock unit provide an offensive capability of the apparatus, and the middle section, the wings, the monitoring assembly provide the defensive capability of the apparatus. In other embodiments, the convex configuration is configured to focus bullet ricochets in a direction of the shots striking the front surface of the apparatus.

Embodiments of this disclosure broadly relate to methods of using electronic shields including providing a shield including a body including a middle section, a forward facing left wing, and a forward facing right wing configured to have a convex configuration, a plurality of spikes or spike deployment assemblies, a plurality of handles disposed in the middle section or in the middle section and the wings, at least three omnidirectional roller assemblies, and a monitoring assembly including a power supply, a processing unit, a display device, cameras, sensors, at least one non-lethal electroshock unit, at least one wireless transmitter and receiver, the at least one microphone, and the at least one speaker, wherein the power supply provides power to the other components via wires, and the processing unit communications and controls the other components via wires or via wireless communication. The methods further include receiving an emergency code transmitted from a facility or from law enforcement or other emergency services via the at least one wireless transmitter and receiver. The methods also include activating one or a plurality of shields; activating inter-shield communication; activating facility communication; and activating law enforcement communication. The methods also include deploying the spikes. The methods also include receiving data, via the processing unit, from the shield cameras and sensors, from the other shield data in a receive other shield data step, from the facility, and law enforcement on a continuous, a periodic, a semi-periodic, and/or an intermittent basis for the duration of the emergency situation; and sending the data, via the processing unit, to the display device. The methods also include displaying the sensor data in a sensor data window on the display device; displaying the other shield data in an other shield data window on the display device; and displaying the law enforcement data in a facility data window on the display device. The methods also include determining, via the processing unit, from any, some, or all of the data an optimal location for the shield or shields from both an offensive and defensive perspective; communicating, via the processing unit, with the other shields, facility personnel, and law enforcement; coordinating, via the processing unit, shield movement with law enforcement and/or other shields based on a dynamics of the emergency situation; repeating the receiving, sending, displaying, determining, communicating, and coordinating steps until the emergency situation is over.

Suitable Components for Use in the Disclosure

Suitable cameras for use herein include, without limitation, any digital camera, CMOS camera, and/or CCD camera. Exemplary digital cameras, CMOS cameras, and/or CCD cameras include cameras manufactured by Avago Technologies, Inc., DALSA Corporation, Datasensor S.p.A, Micron Technology, Inc., OmniVision Technologies, Photonfocus AG, Pixelplus Co., Ltd. Dalles Electronics Co., Ltd., DEPO Manufacturing Corp, Digirad Corporation, FastCAM Replay, LLC, Fastec Imaging Corporation, MegaVision, Inc., Nikon Inc., Olympus America, Prosilica Inc., Rollei GmbH, Roper Scientific, Inc., Shuoying Industrial (Shenzhen) Co., Ltd., Silicon Imaging, Inc., Sunox Technology Ltd., or similar manufacturers and combinations thereof.

Suitable motion sensors for uses herein include, without limitation, any sensor capable of sensing motion. Exemplary motion sensors include, without limitation, motion sensors manufactured by Vega, IFM Efector, Inc., Mouser Electronics, Inc., Data Instruments, Eaton, GHI, Hamlin, Honeywell, Memsic, Sfernice, Zilog, Select Controls, Inc., Steven Engineering, Custom Sensors & Technologies, Honeywell, Leviton, Pepperl+Fuchs, Euchner-USA, Inc., Siemens Process Instrumentation, TE Connectivity, SunSource, TTI, Inc., Eaton, OTP Industrial Solutions, Sensata Technologies, Total Refrigeration Gaskets, Inc., Novotechnik U.S., Inc., IVEC Systems, RDP Electrosense, Inc., Process Control Systems, Inc., PI (Physik Instrumente) L.P., Telkonet, Inc., EcoSense detectors, Spectec, Celera Motion, Sonich Industrial Sales Co., Inc., Marsh Electronics, Inc., Temp-Press, Inc., Micro-Epsilon, IFM Efector, Inc., Telemecanique Sensors, Industrial Controls, Honeywell Sensing and Control, Erhardt+Leimer, Inc., Maxim Integrated, Vortex Systems, LLC, Leviton Manufacturing Co., Inc., Inertial Labs, Schneider Electric, Global Controls & Electric, PICS INC—Malvern, Pa., and combinations thereof.

Suitable processing units for uses herein include, without limitation, for use in the present disclosure include, without limitation, digital processing units (DPUs), analog processing units (APUs), Field Programmable Gate Arrays (FPGAs), any other technology that may receive motion sensor output and generate command and/or control functions for objects under the control of the processing unit, and/or mixtures and combinations thereof.

Suitable digital processing units (DPUs) include, without limitation, any digital processing unit capable of accepting input from a plurality of devices and converting at least some of the input into output designed to select and/or control attributes of one or more of the devices. Exemplary examples of such DPUs include, without limitation, microprocessor, microcontrollers, or the like manufactured by Intel, Motorola, Ericsson, HP, Samsung, Hitachi, NRC, Applied Materials, AMD, Cyrix, Sun Microsystem, Philips, National Semiconductor, Qualcomm, or any other manufacture of microprocessors or microcontrollers, and/or mixtures or combinations thereof.

Suitable analog processing units (APUs) include, without limitation, any analog processing unit capable of accepting input from a plurality of devices and converting at least some of the input into output designed to control attributes of one or more of the devices. Such analog devices are available from manufacturers such as Analog Devices Inc.

Suitable display devices for uses herein include, without limitation, any display device. Exemplary display devices include, without limitation, display devices manufactured by AU Optronics, BOE, BPL Group, Phillips, Casio, Chungwha Picture Tubes, Epson, Giantplus technology, HannStar Display Corporation, Hitachi, HKC, Iiyama, InnoLux Corporation, Display, Kyocera, LG Display, LXD Incorporated, Medion, NEC Display Solutions, New Vision Display, Mitsubishi Electric, Orion Electric, Orion Electronics, Panasonic Corporation, Pioneer, Planar Systems, Samsung Electronics, Sharp Corporation, S-LCD(former), TCL, Tianma, Toshiba, Truly Semiconductors, Vestel, Videocon, Walton, Winstar display, PalmTech, Maclight Display, and combinations thereof.

Suitable non-transparent ballistic materials for uses herein include, without limitation, any non-transparent ballistic material such as metals, e.g., iron, steel, titanium, vanadium, tungsten, or alloys thereof, ballistic fabrics, ballistic plastics, and/or ballistic composites such as Kevlar, UHMWPE, Lexan, and/or carbon fiber composite materials, or mixtures and combinations thereof. Exemplary ballistic fabrics including, without limitation, ballistic fabrics manufactured by Eastex Products, Inc., Tex Tech Industries, Mauritzon, Inc., Stern & Stern Industries, Inc., Emtexglobal, Mil-Spec Industries Corp., Chapel Hill Mfg., Fabric Development, Inc., AH&H Inc., Lincoln Fabrics, Ltd., Sioux Manufacturing Corp., Warwick Mills, Inc., VSQ, LLC, and mixtures or combinations thereof. Exemplary ballistic ceramic materials including, without limitation, ballistic ceramic materials manufactured by CeramTec North America, LLC, MarkeTech International, CerCo, LLC, PROTECH Armor Systems, High Impact Technology, LLC, Mil-Spec Industries Corp., Survival Armor, ArmorStruxx, LLC, PT Armor, Inc., Armored Mobility, Inc., Armorup LP, International Armor Corporation, IJ Research, Inc., BAE Systems, ArmorWorks, Amendment II, U.S. Armour Corp., Aces'Armored Combat Equipment Systems' Inc, Compotech, Inc., L&L Products Inc., Baker Ballistics, Verco Materials, LLC, United Shield International LLC, Citadel Defense Technologies, Protective Solutions, Inc., Clear Ballistics LLC, TenCate—Advanced Composites, Armor Express, VSQ, LLC, and mixtures or combinations thereof.

Suitable transparent ballistic materials for uses herein include, without limitation, any transparent ballistic material or mixture thereof such as bullet proof glass, glass laminate, polycarbonate, acrylic, glass-clad polycarbonate, and/or aluminum oxynitride. Exemplary transparent ballistic materials manufactured by Johnson Bros. Roll Forming Co., Emco Industrial Plastics, Inc., E & T Plastics Mfg. Co., Inc., Johnson Plastic & Supply Co., Inc., Orange County Industrial Plastics (OCIP), Alpha Plastic & Design, Therm-O-Lite, Inc., National Bullet Proof Inc., Total Security Solutions Inc., Bulldog Direct Protective Systems, Inc., Acrilex, Inc., Acme Plastics, Inc., PROTECH Armor Systems, Protective Structures Ltd., Bullet Guard, American Acrylic Corp., Total Plastics, Inc., Glasforms, Inc., Mil-Spec Industries Corp., High Impact Technology, LLC, Aircraft Rubber Mfg., Inc., ArmorCo Advanced Armoring Products, Ballistic Trap Media, Industrial Packing & Seal Co., Inc., Deansteel Manufacturing Co., Armortex, L&L Products Inc., San Castle, LLC, Protec America, Inc., and mixtures or combinations thereof.

Suitable worm drives include, without limitation, DieQua Corporation, Sumitomo Machinery Corporation of America, Nanotec Electronic U.S., Inc., STOBER Drives Inc., Motovario Corp., Cleveland Gear Company, NEUGART USA, Framo Morat, Inc., KNK USA, Allied Sinterings, Inc., Anaheim Automation Company, Andantex USA, Inc., Apex Dynamics, USA, ATLANTA Drive Systems, Inc., B&D Industrial, Baldor Electric Company, Bison Gear & Engineering Corp., Bloom Manufacturing Incorporated, Bluffton Motor Works, Bond Machine and Fabrication, Boston Gear, Carter Motor Company, Cone Drive, Cotta Transmission Company, or other worm drive manufacturers.

Suitable electromagnetic, hydraulic, or pneumatic solenoid actuators include, without limitation, F.W. Webb Company, Steven Engineering, HYDAC Technology Corporation, BI-TORQ Valve Automation, Caylor Industrial Sales, Inc., Geeplus, Inc., Ohio Pipe, Valve & Fittings, Inc., American Precision Supply, Inc., Ross Engineering Corp., Magnet Schultz of America, Husco International, Inc., ECCO/Gregory, Inc., Semcor, or other electromagnetic, hydraulic, or pneumatic solenoid actuators.

Suitable omnidirectional mobile devices, both non-motorized and motorized, including, without limitation, devices manufactured by Fuji Seisakusho Co., Ltd., Rotacaster Wheel Pty Ltd, or any other manufacturer of omnidirectional drives or locomotion devices.

DETAILED DESCRIPTION OF THE DRAWINGS OF THE DISCLOSURE

Shield Having a Straight Middle Section and Straight Wings

Referring now to FIGS. 1A-D, an embodiment of a shield apparatus of this disclosure, generally 100, is shown in a front plan view, a rear plan view, a top plan view and a bottom plan view. Looking at FIG. 1A, the shield apparatus 100 is shown to include a middle section 102, a forward oriented left wing 104, a forward oriented right wing 106, a transparent window 108, and three omnidirectional roller housing 110, each of the omnidirectional roller housings 110 includes an omnidirectional roller member 112, which may be a caster or a ball. Looking at FIG. 1B, the shield apparatus 100 is also shown to include handles 114 disposed on the back of the shield to allow the shield 100. Looking at FIGS. 1C&D, the wings 104 and 106 are angled forward by an angle $\alpha$, where the angle $\alpha$ has a value ranging between about 15° to about 65°. In certain embodiments, the angle $\alpha$ has a value ranging between about 20° to about 60°. In certain embodiments, the angle $\alpha$ has a value ranging between about 30° to about 50°. In certain embodiments, the angle α is about 45°. The handles 114 may be located on the middle section 102, on the wings 104 and 106, or on the middle section 102 and the wings 104 and 106. The handle 114 are designed and configured to allow a user to move the shield 100 facilitated by the rollers in any direction and to allow the user the capability of moving forward or backward and to rotate the shield 100 as that the wings 104 and 106 giving the user both offensive and defensive capability. Thus, by moving forward and rotating, the use may be able to crash the shield middle and/or wings into an active shooter without be exposed to bullets or other weapons under control of the assailant.

Referring now to FIGS. 1E&F, the shields 100 may also include a backward oriented left wing 116 and a backward oriented right wing 118, where the backward oriented wings 116 and 118 improve defensive capacity and additional roller housings 110 and roller members 112.

Referring now to FIGS. 1G&H, the shields 100 may also include shield mounting and locking members 120.

Referring now to FIGS. 1I&J, the shields 100 may also include the shield mounting and locking members 120 engaging wall mounting and locking members 122 and a biometric lock and scanner 124 for storage of the shields 100, when not being used. The figures show the shield mounting and locking members 120 engaging the wall mounting and locking member 122 controlled by the biometric lock and scanner 124 mounted in a wall 126, where the biometric lock and scanner 124 are in communication and power the mounting and locking members 120 and 122 via wires 128. It should be recognized that the shield mounting members and the wall mounting members may be of type that secure the shield to a wall or shield enclosure for quick release of the shield 100 using the biometric lock and scanner 124.

Curvilinear Shields and Shields with Curved Wings

Referring now to FIGS. 2A-F, another embodiment of a shield apparatus of this disclosure, generally 200, is shown in a front plan view, a rear plan view, a top plan view and a bottom plan view. In these embodiments, the shields 200 comprise curved shields and not shield that have straight wings as described in FIGS. 1A-F. Looking at FIG. 2A, the shield apparatus 200 is shown to include a middle section 202, a left wing 204, a right wing 206, a transparent window 208, three omnidirectional roller housing 210, each of the omnidirectional roller housings 210 includes an omnidirectional roller member 212, and a plurality of spikes 216, shown here extending outward from the middle 202. Looking at FIG. 2B, the shield apparatus 200 is also shown to include handles 214. In this embodiments, the handles 214 consist of eight (8) handles positioned to accommodate different user heights and arm spans or to provide the user with different handles for controlling the shield during use.

In these embodiments, the shields 200 comprise curved shields and not shields that have a straight middle and/or straight wings as described in the embodiments of FIGS. 1A-F.

Figure 2A:
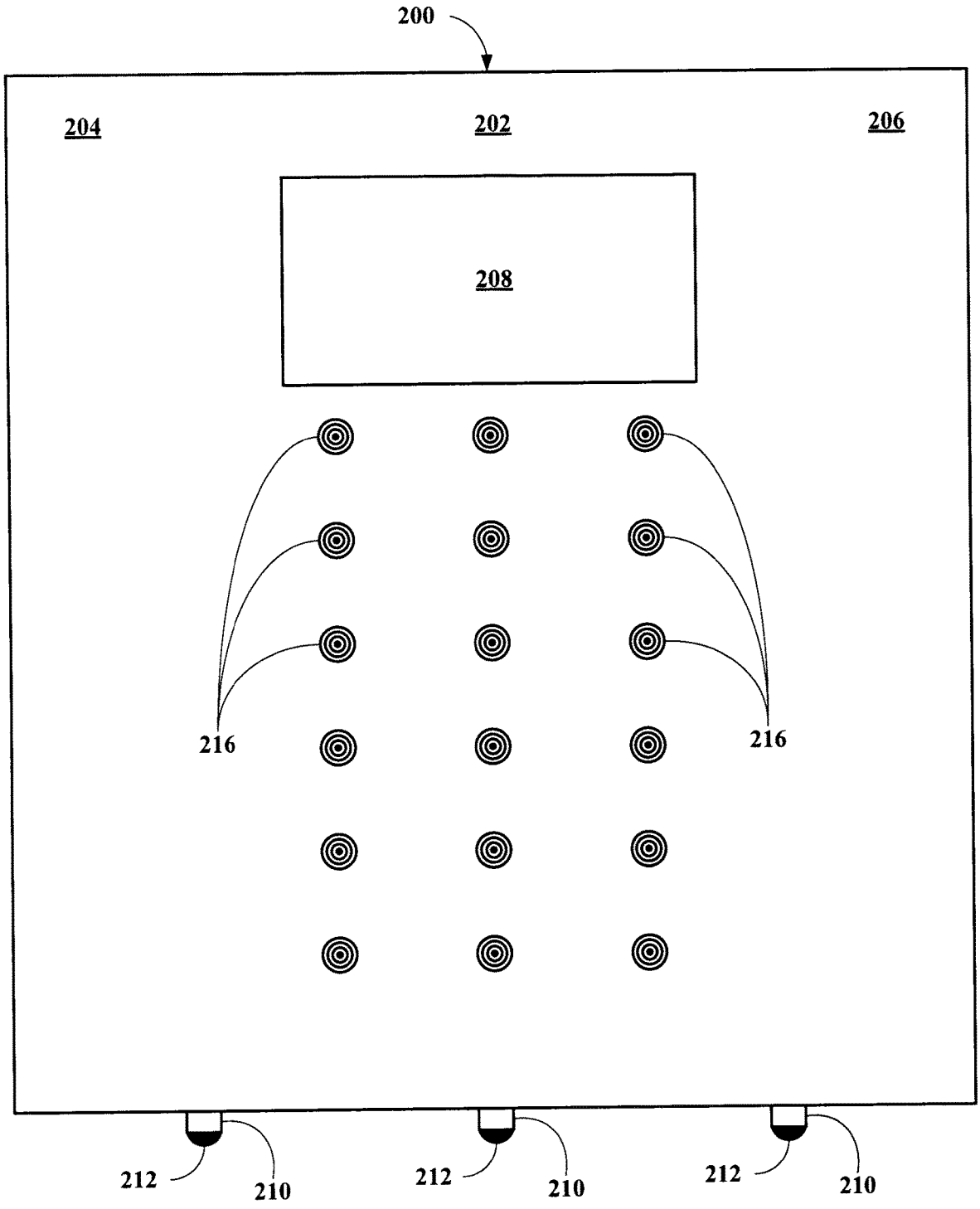
Figure 2B:
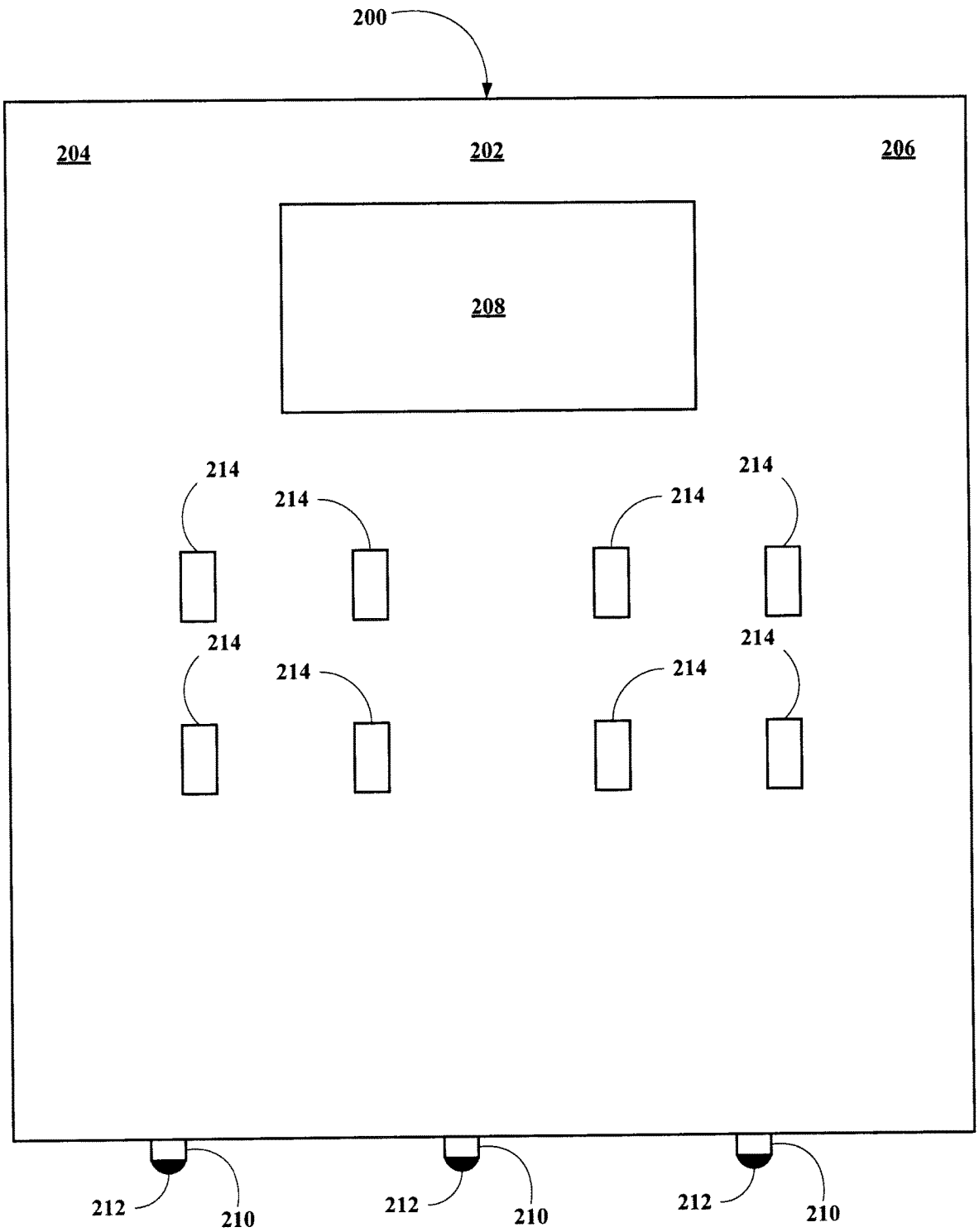
Figure 2C:
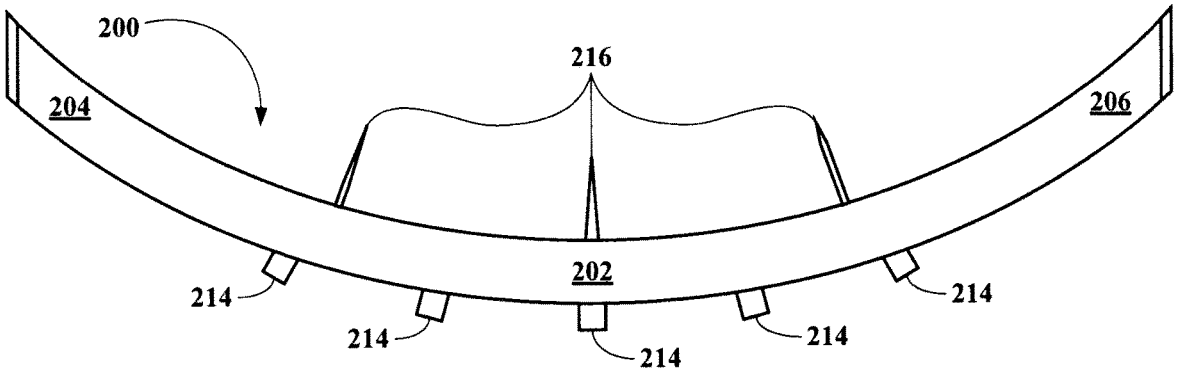
Figure 2D:
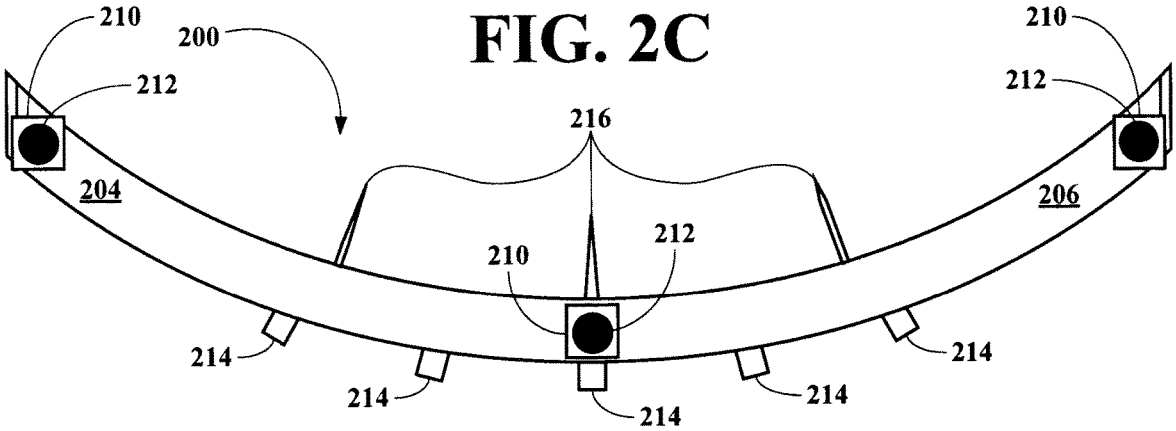

Looking at FIGS. 2C&D, the shield 200 comprises an arcuate configuration having a constant curvature, where a degree of curvature of the shield is measured from a middle 202 defining a curved middle 202, and curved wings 204 and 206. In these curved embodiments, the degree of curvature may range between about 5° to about 40°. In certain embodiments, the degree of curvature ranges between about 5° to about 30°. In certain embodiments, the degree of curvature ranges between about 5° to about 20°. In certain embodiments, the degree of curvature ranges between about 5° to about 10°. It should be recognized that the actual value be any value within the range or any subrange. Thus, any range includes every permissible value within the range and any permissible subrange.

Figure 2E:
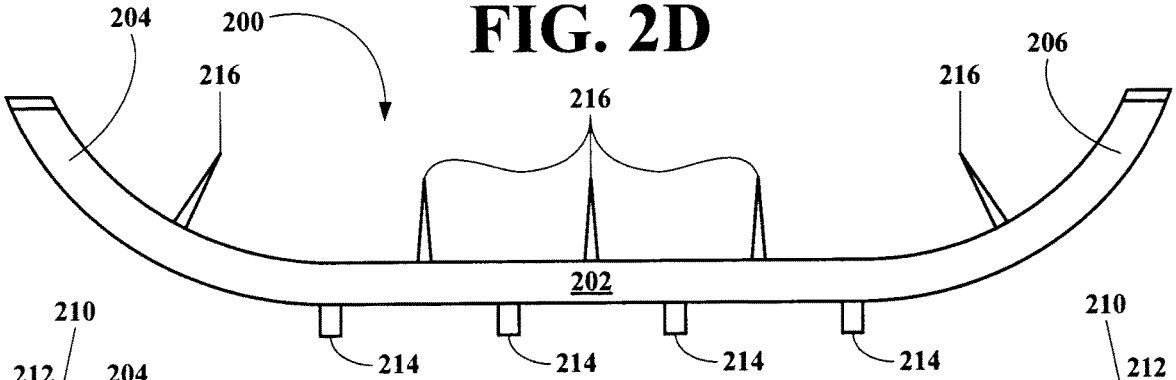
Figure 2F:
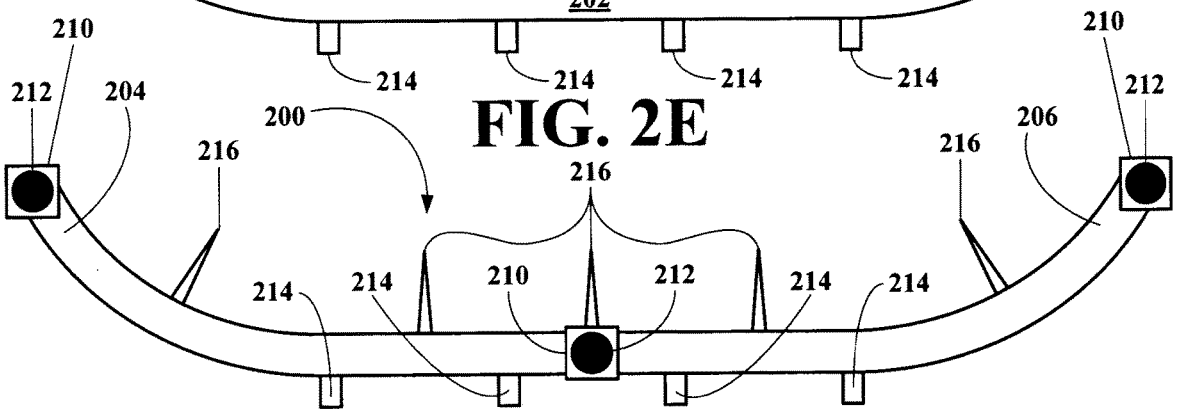

Looking at FIGS. 2E&F, the shield 200 comprises an arcuate configuration having a straight middle section 202 and two curved wings 204 and 206, where a degree of curvature of the wings may range between about 5° to about 60°. In certain embodiments, the degree of curvature of the wings ranges between about 15° to about 50°. In certain embodiments, the degree of curvature of the wings ranges between about 20° to about 50°. In certain embodiments, the degree of curvature of the wings ranges between about 30° to about 50°. In certain embodiments, the degree of curvature of the wings is about 45°. Again, the ranges includes every permissible value within the range and any permissible subrange.

The spikes 216 have be of any design such as narrow tapered spikes, wider tapered spikes, and spikes that are cylinders having pointed tips. It should be recognized that the spikes may be of any design and configuration and may includes any combination of such spikes. The spikes 216 may be disposed on the middle section 202, the wings 204 and 206, or on the middle 202 and the wings 204 and 206. The spikes 216 are provide the shields 200 with a formidable offensive capability so that the shield may be moved toward an assailant to inflict damage to the assailant to stop or prevent further acts or to deter further acts. The spikes 216 may be fixed or retractable, where retractable are described herein. The spikes 216 may be affixed to the shield 200 by any method known in the art such as welding, brazing, or may be integral. Spikes 216 may also be detachable such as being screwed into the shields 202.

Shields Having Cameras, Sensors, and Processing Units

Referring now to FIGS. 3A&B, another embodiment of a shield apparatus of this disclosure, generally 300, is shown in a front plan view and a rear plan view. It should be recognized that the configuration of the shield 300 have be any configuration including straight middle and straight angled wing shields, straight middle and curved wing shields, or continuously curved shields.

Looking at FIG. 3A, the shield apparatus 300 is shown to include a middle section 302, a left wing 304, a right wing 306, and spikes 308. The shield 300 also includes three omnidirectional roller housing 310, each of the omnidirectional roller housings 310 includes an omnidirectional roller member 312. The shield 300 also includes monitoring devices including cameras 314 and sensors 316 such as motion sensors, thermal sensors, ultrasonic sensors, IR sensors, or other sensors that may be used to detect assailants.

Figure 3B:
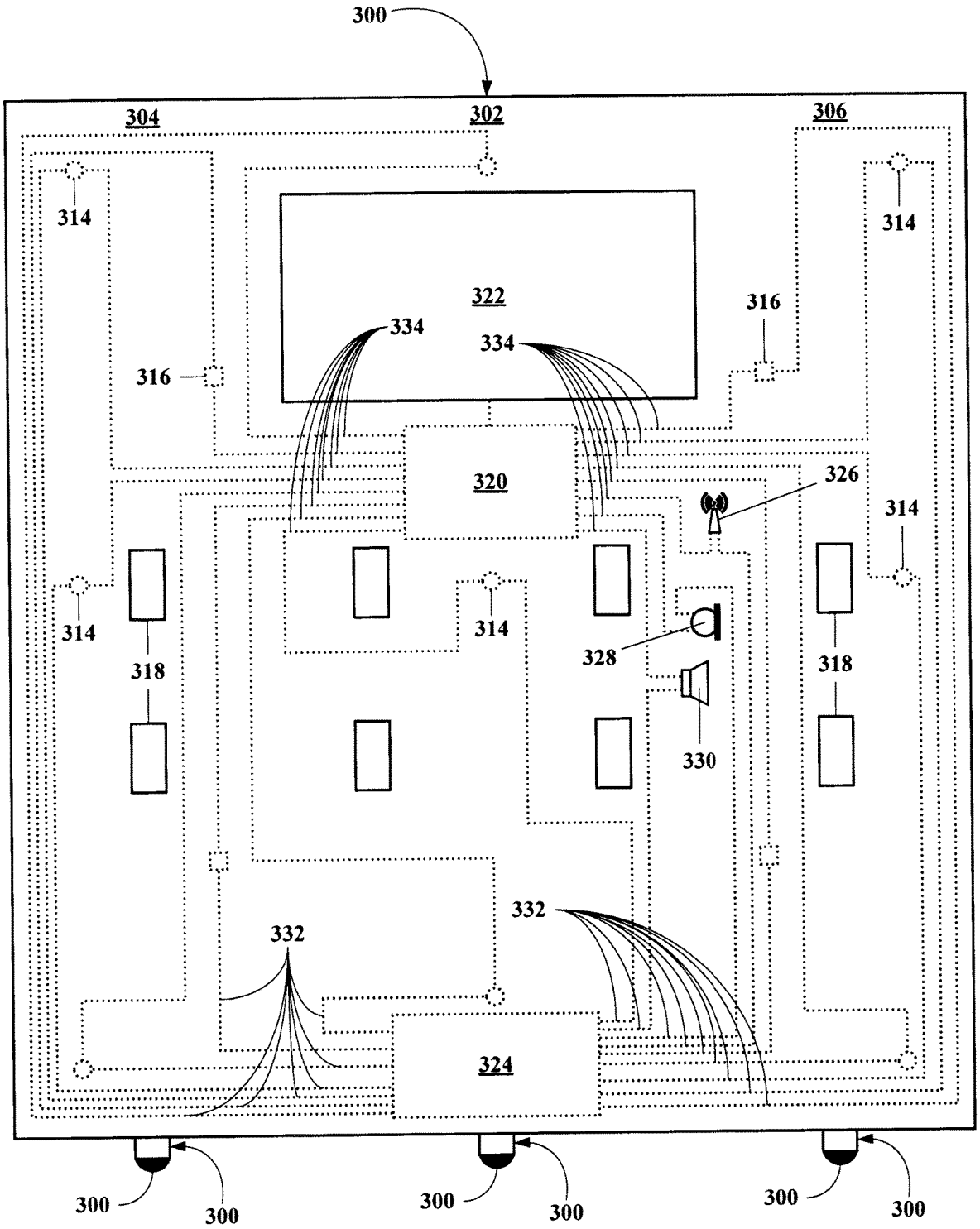

Looking at FIG. 3B, the shield apparatus 300 again includes handles 318 for moving the shield 300. The shield 300 further includes a processing unit 320, a display device 322, and a power supply 324. The shield 300 also includes at least one wireless transmitter and receiver 326, at least one microphone 328, and at least one speaker 330. The power supply 322 provide power to the cameras 314, the sensors 316, the processing unit 320, the display device 322, the wireless transmitter and receivers 326, the microphones 328, and the speaker 330 via wires 332. Of course, it should be recognized that some of the devices may be powered by fields. The processing unit 320 is in communication with the cameras 314, the sensors 316, the display device 322, the wireless transmitter and receivers 326, the microphones 328, and the speaker 330 via wires 334. Of course, it should be recognized that one, some, or all of the components may communication with the processing unit 318 wirelessly via such formats a Bluetooth® or other wireless communication protocols.

The cameras 314 and the sensors 316 provide information to the processing unit 320 that is displayed on the display device 322. Additionally, the processing unit 320 may be configured to receive information from the facility, cameras or other sensor in the facility, law enforcement, and other data from other source that may be displayed on the display 322 so that the user may be kept current on the threat and the processing unit 320 may use data from all the source to determine the best defensive and offensive location for the shield 300.

Manual Spike Deployment and Retraction Assemblies Having Lever Arms

FIGS. 4A&B depict a cross-sectional view of an embodiment of a manual spike deployment assembly, generally, 400, disposed on a rear surface 402 of a middle section 404 of a shield 406 of this disclosure. The shield 406 also includes omnidirectional roller housings 408 and omnidirectional roller members 410. The assembly 400 includes a mount 412 including a rotatable member 414, where the mount 412 is affixed to the surface 402 at a location 416. The assembly 400 also includes a lever arm 418 affixed at a proximal end 420 to the rotatable member 414 and having a handle 422 at a distal end 424. The assembly 400 also includes a spike deployment/retraction arm 426 affixed at a proximal end 428 to the rotatable member 414 and affixed to a spike bar 430 at a distal end 432. The spike bar 430 has spikes 434 affixed thereto at an angle β. The angle β may range from about 90° to about 45°, but smaller angles may be used as well. In certain embodiments, the β ranges from about 80° to about 50°. In other embodiments, the β ranges from about 70° to about 60°. The assembly 400 also includes apertures 436 through which the spikes 434 traverse during deployment and retraction. The assembly 400 operates as follows. A user grabs the handle 422 and pulls the lever arm 418 down causing the deployment arm 426 to push the spikes 434 through the apertures 436 so that a portion 438 of the spikes 434 extent outward from a front surface 440 of the shield 406. The assembly 400 may also include a locking mechanism 442 for locking the bar 432 in place after spike deployment. The locking mechanism 442 may be any device that will prevent the spike 434 to move after deployment. Here the locking mechanism 442 comprises an arm 444 having a male snap 446 configured to engage a female snap 448 affixed to and disposed on the rare surface 402 of the shield 406.

Referring now to FIGS. 5A-E, another embodiment of a spike deployment assembly, generally 500, is shown disposed on a rear surface 502 of a middle section 504 of a shield 506 of this disclosure. The shield 406 also includes omnidirectional roller housings 508 and omnidirectional roller members 510.

Figure 5A:
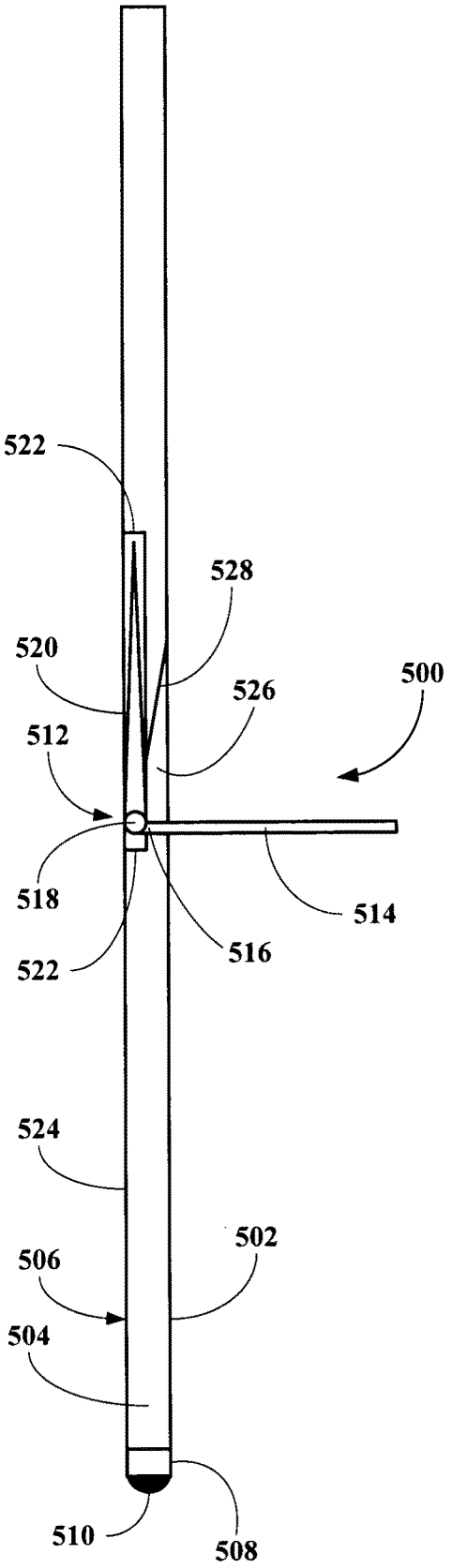
Figure 5B:
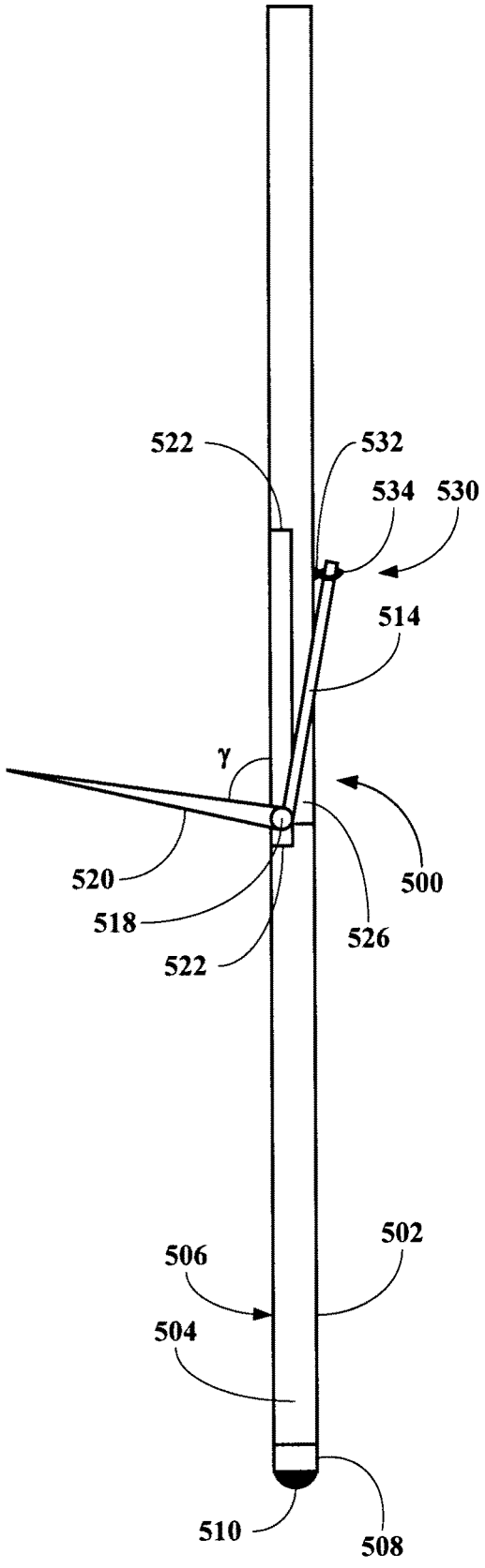

Looking at FIGS. 5A&B, the assembly 500 is disposed at a location 512 and includes a lever arm 514 affixed at a proximal end 516 to a spike bar 518. The spike bar 518 has spikes 520 affixed thereto. The assembly 500 also includes spike retraction grooves 522 disposed in a front surface 524 of the middle 504 of the shield 506 and into which the spikes 520 are stored during storage or non-deployment. The assembly 500 also includes a lever arm groove 526 including a deployment stop 528. The assembly 500 operates as follows. A user grabs the lever arm 514 and pushes the lever arm 514 up causing the deployment of the spikes 520 from the groove 522 and stops at the stop 528. The spikes 520 assume an orientation with the front surface 524 with an angle γ. The angle γ may range from about 90° to about 45°, but smaller angles may be used as well. In certain embodiments, the γ ranges from about 80° to about 50°. In other embodiments, the γ ranges from about 70° to about 60°. Again, the assembly 500 may also include a locking mechanism 530. Here the mechanism 530 comprises a band anchor 532 and a flexible band 534 that may be looped around a distal end 536 of the lever arm 514.

Figure 5C:
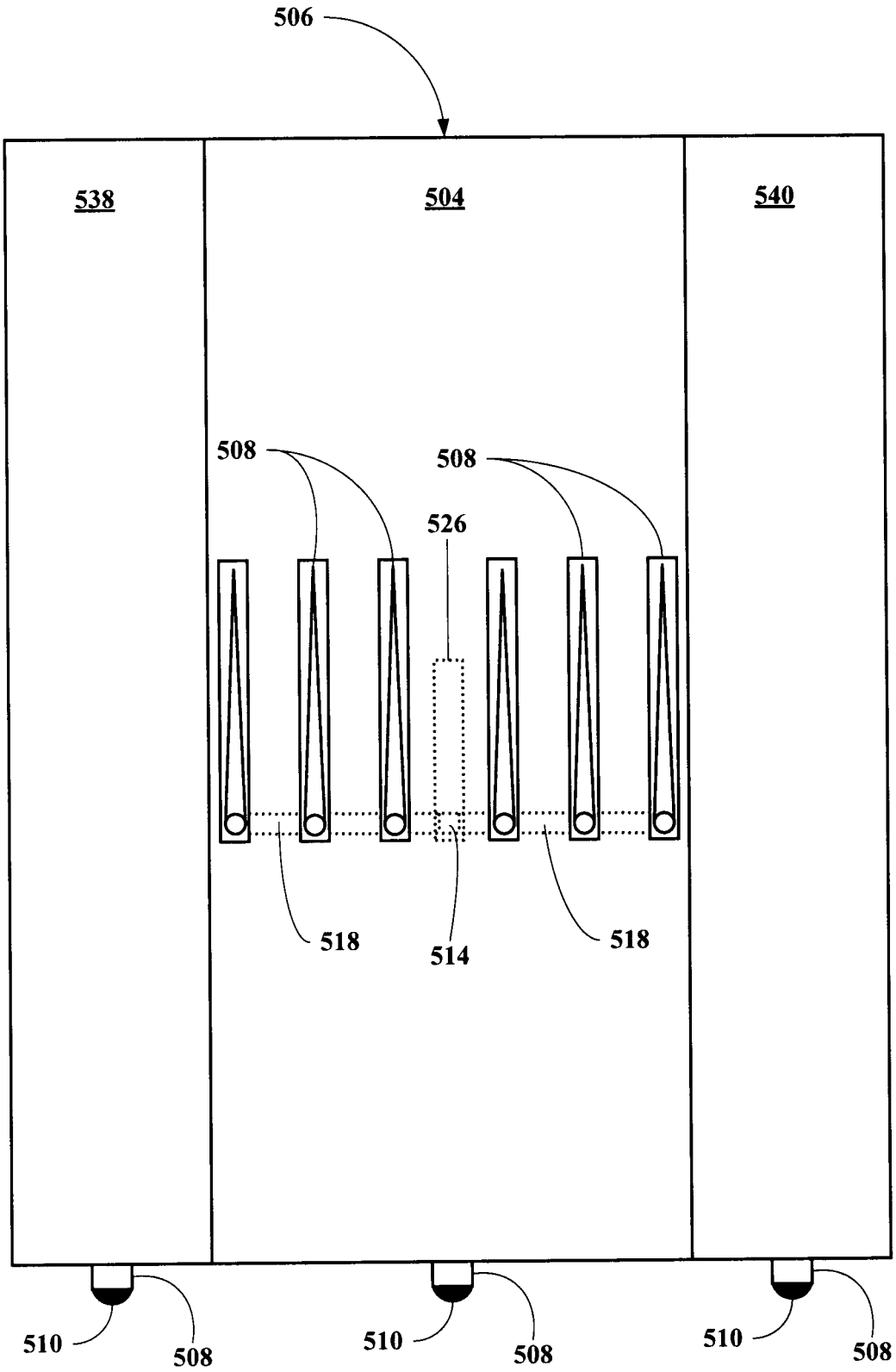
Figure 5D:
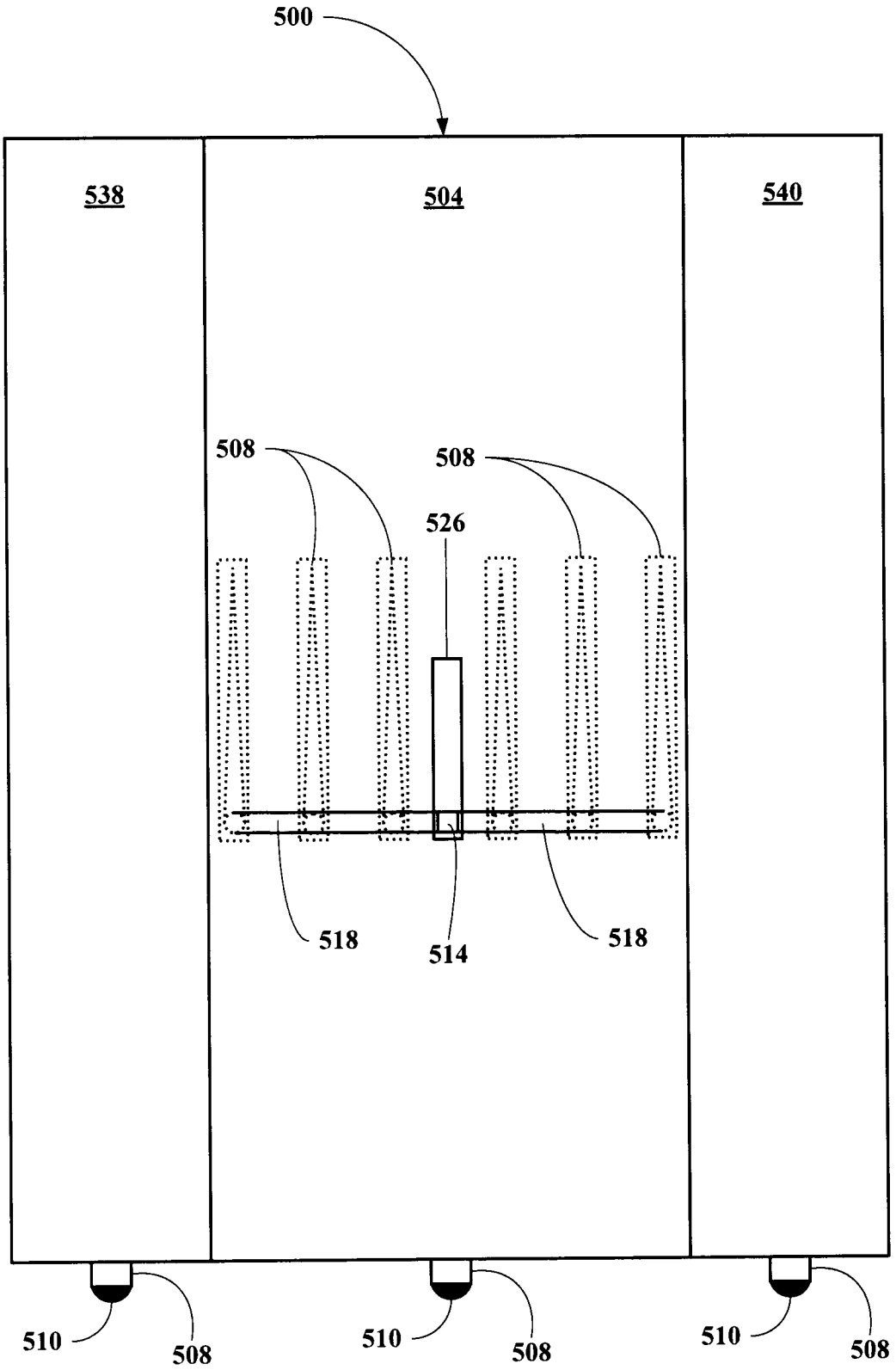
Figure 5E:
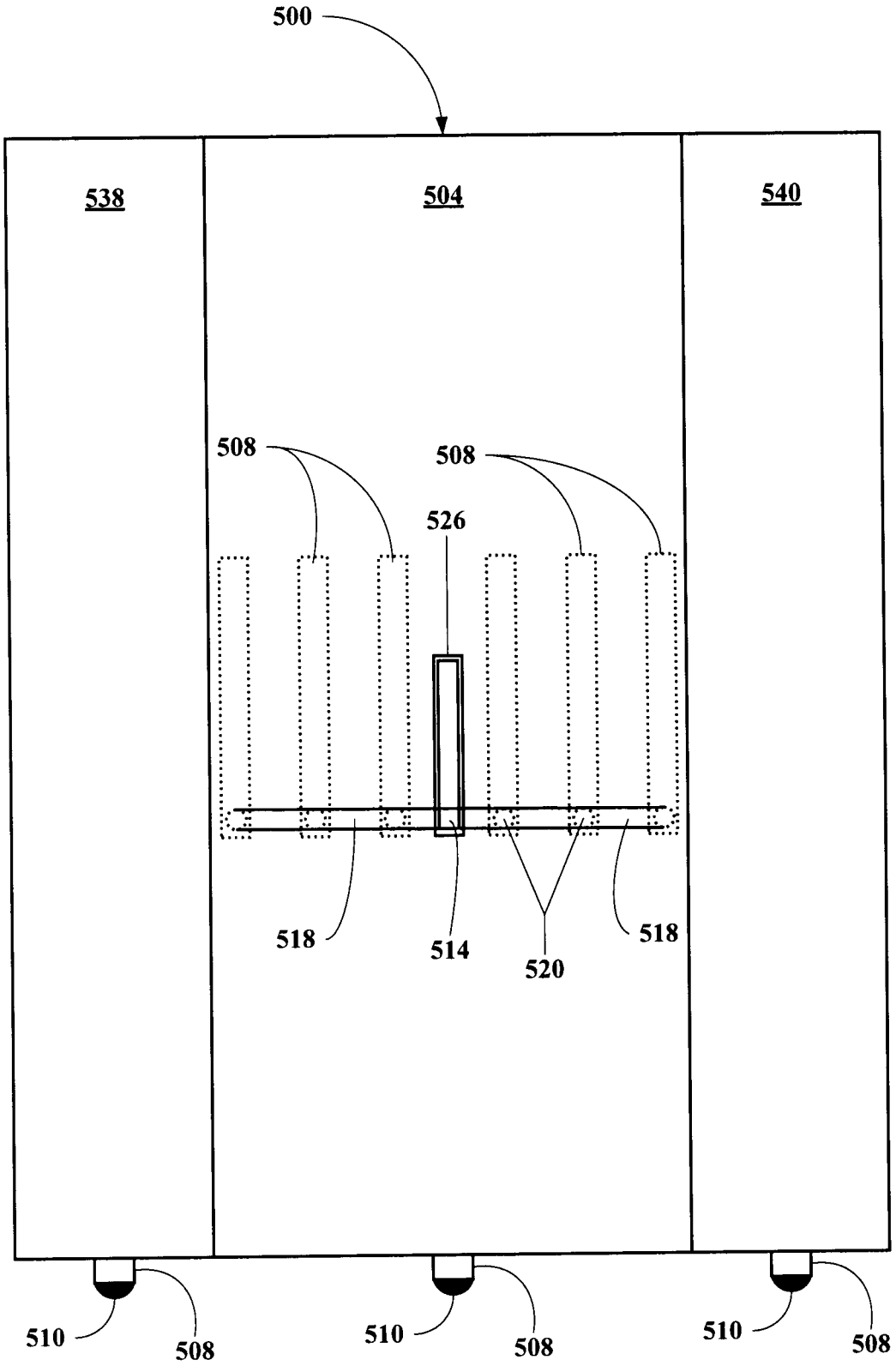

Looking at FIG. 5C-E, front and rear views are shown. The shield 506 is shown to include six spikes 518 and six spike grooves 522 affixed to the spike bar 518 and the lever arm groove 526 and the lever arm 514. The spikes 518 are disposed in the middle 504 and not the wings 538 and 540.

Spring Loaded Manual Spike Deployment and Retraction Assemblies

Figure 6A:
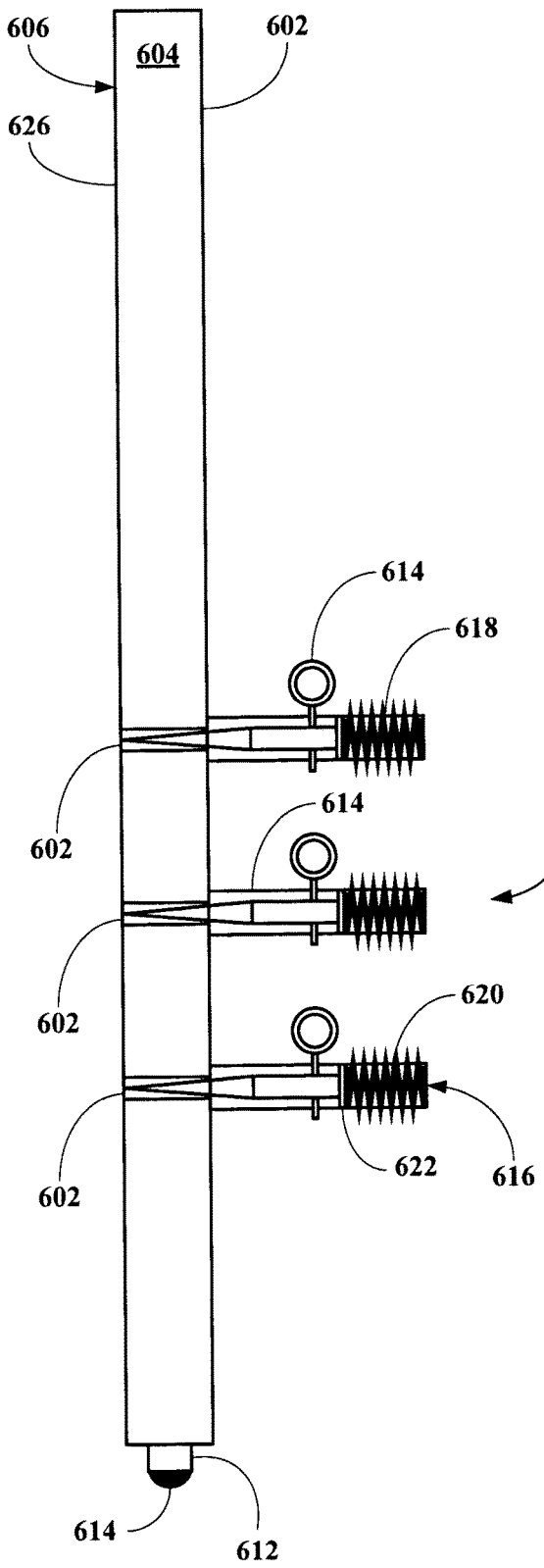
Figure 6B:
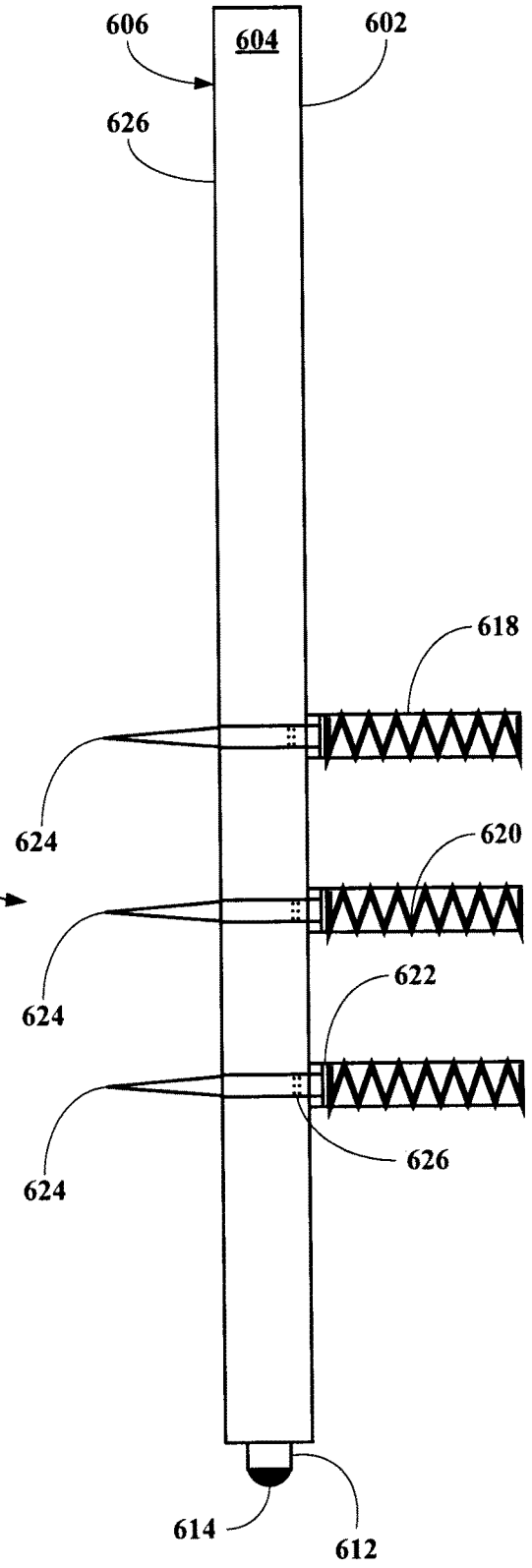
Figure 6C:
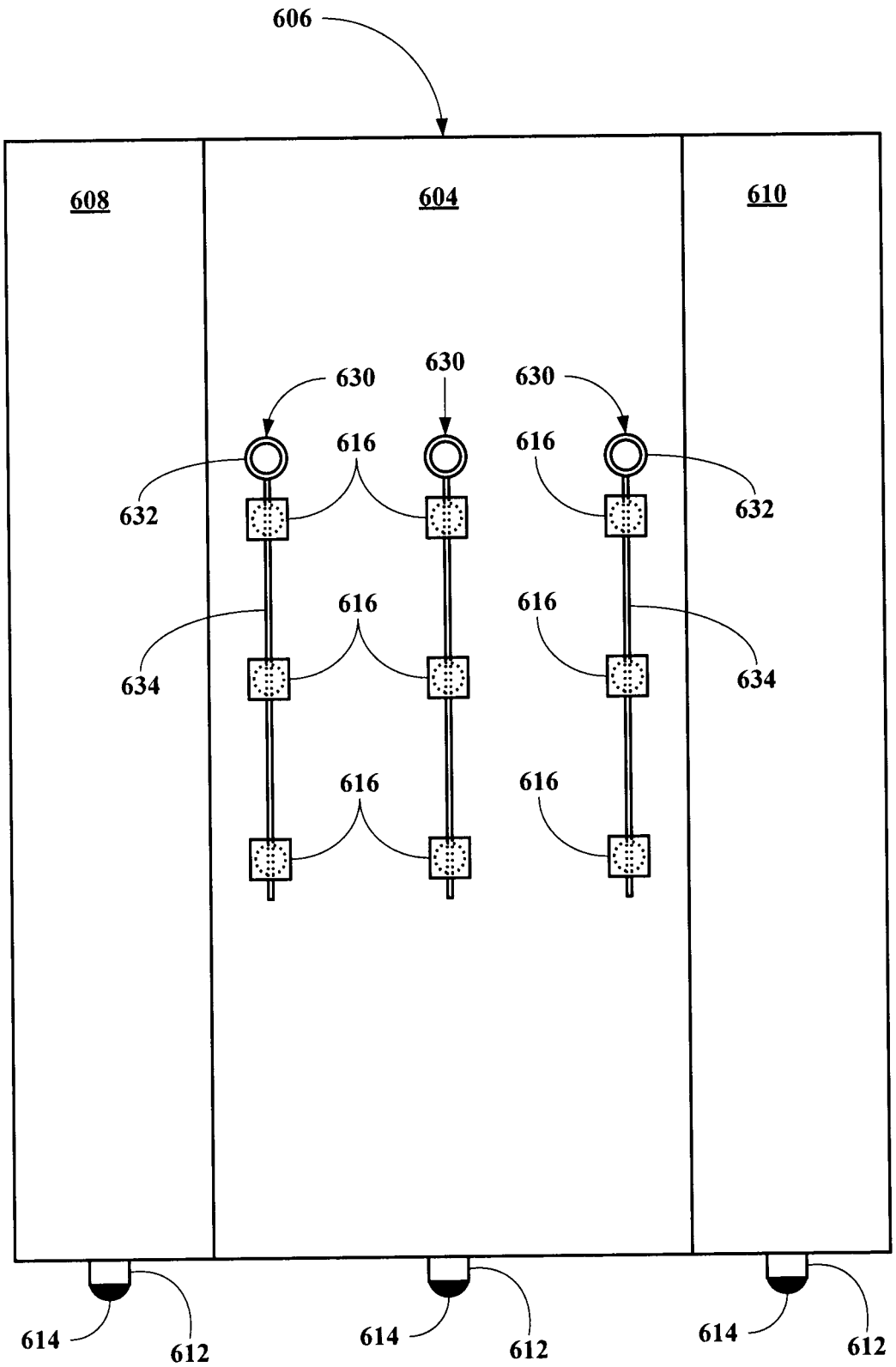

Referring now to FIGS. 6A&B, two cross-sectional view of another embodiment of a manual spike deployment assembly, generally 600, is shown disposed on a rear surface 602 of a middle section 604 of a shield 606 that also includes a left wing 608 and a right wing 610 shown in FIGS. 6C&D. The shield 606 also includes omnidirectional roller housings 612 and omnidirectional roller members 614. The shield 600 also includes a plurality of spring loaded spike deployment assemblies 616. Each of the spring loaded spike deployment assemblies 616 includes a housing 618, a spring 620, a stop 622, a spike 624 having an aperture 626 therethrough, and a release key pin 628. FIG. 6A shows the assembly 600 in its retracted state, while FIG. 6A shows the assembly 600 in its deployed state.

Referring now to FIG. 6C, the assembly 600 is shown to include nine spring loaded spike deployment assemblies 612 and three release key pin rods 630 including a tab 632 and a rod 634. Each of the rods 632 extends vertically through three vertically aligned spring loaded spike deployment assemblies 612 so that pulling the tab 630 releasing the three spikes 634 associated with each rod 632.

Figure 6D:
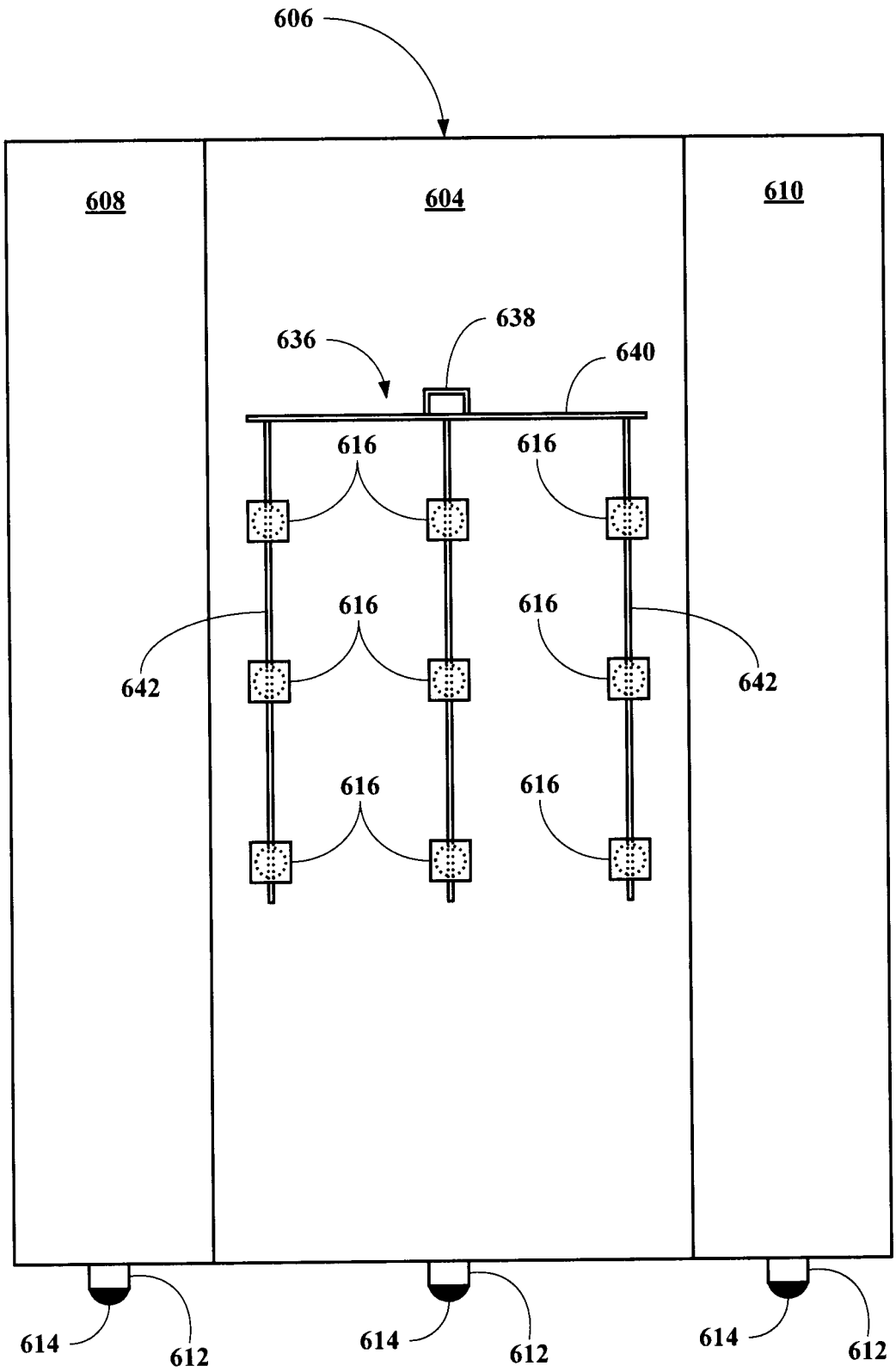

Referring now to FIG. 6D, the assembly 600 is shown to include nine spring loaded spike deployment assemblies 612 including a single release key pin rod 636 including a handle 638, a horizontal rod 640 and three vertical rods 642 extending vertically through three sets of three vertically aligned spring loaded spike deployment assemblies 612 so that pulling the tab 636 releasing all nine spikes 624.

Solenoid Spike Deployment and Retraction Assemblies

Figure 8B:
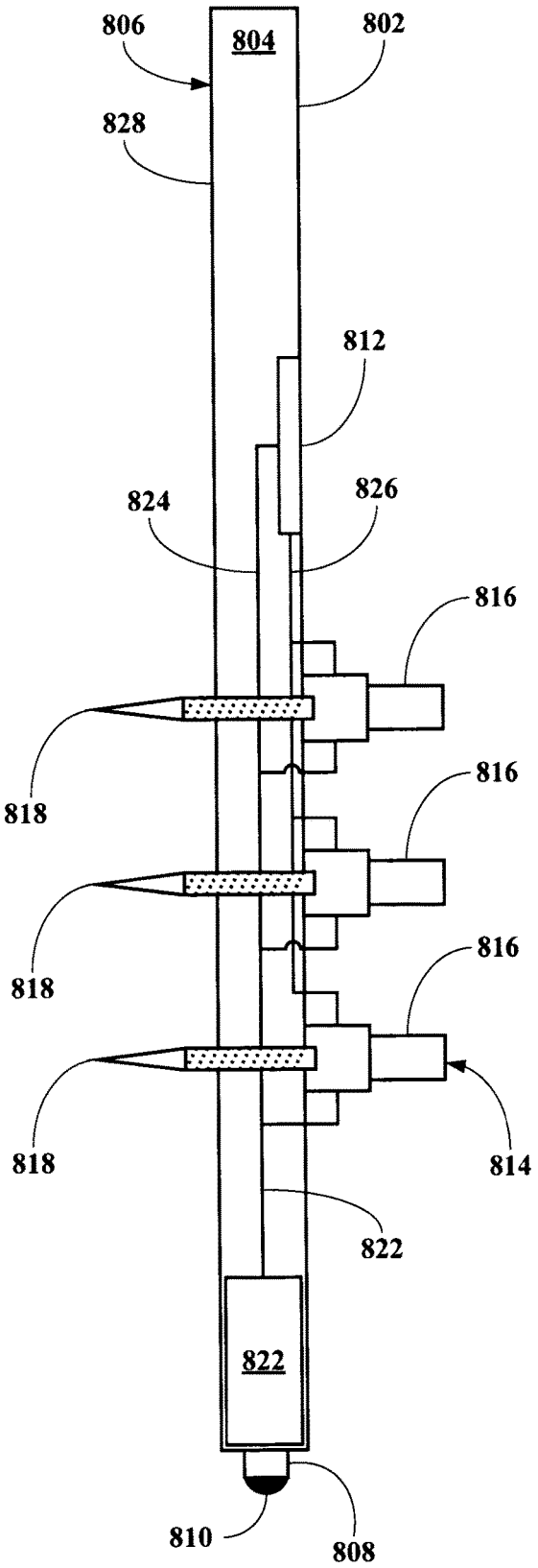

FIGS. 7A&B, two cross-sectional side views of an embodiment of an automatic spike deployment assembly, generally 700, is shown disposed on a rear surface 702 of a middle section 704 of a shield 706 of this disclosure, in a retracted state and a deployed state. The shield 706 also includes omnidirectional roller housings 708 and omnidirectional roller members 710. The assembly 700 is shown here to include a processing unit 712 and automatic spike deployment assemblies 714. Each of the automatic spike deployment assemblies 714 includes a solenoid 716 having a deployable spike 718 and apertures 720 in the middle section 704 through which the spike 718 may transition between a non-deployed state shown in FIG. 7A to a deployed state shown in FIG. 7B. The assembly 700 also includes a power supply 722. The power supply 722 supplies power to the solenoids 716 and the processing unit 712 via wires 724. The processing unit 712 is in communication with the solenoids 716 via wires 726 and the processing unit 712 is configured to transition the spikes 718 between the non-deployed state and the deployed state in response to a command entered or spoken, where the spikes 718 extend from a front surface 728 of the shield 706. It should be recognized that the shield 706 may also include a window and display device or both. Of course, these automatic Worm Drive Spike Deployment and Retraction Assemblies Referring now to FIGS. 8A&B, two cross-sectional side views of another embodiment of an automatic spike deployment assembly, generally 800, is shown disposed on a rear surface 802 of a middle section 804 of a shield 806 of this disclosure, in a retracted state and a deployed state. The shield 806 also includes omnidirectional roller housings 808 and omnidirectional roller members 810. The assembly 800 is shown here to include a processing unit 812 and automatic spike deployment assemblies 814. Each of the automatic spike deployment assemblies 814 includes a worm drive 816 having deployable threaded spike 818 and apertures 820 in the middle section 804 through which the spike 818 may transition between a non-deployed state shown in FIG. 8A to a deployed state shown in FIG. 8B. The assembly 800 also includes a power supply 822. The power supply 822 supplies power to the worm drives 814 and the processing unit 812 via wires 824. The processing unit 812 is in communication with the worm drives 816 via wires 826 and the processing unit 812 is configured to transition the spikes 818 between the non-deployed state and the deployed state in response to a command entered or spoken, where the spikes 818 extend from a front surface 828 of the shield 806. It should be recognized that the shield 806 may also include a window and display device or both.

Motorized Shields

Referring now to FIG. 9, another embodiment of a motorized shield apparatus, generally 900, is shown in a rear plan view. It should be recognized that the configuration of the shield 900 have be any configuration including straight middle and straight angled wing shields, straight middle and curved wing shields, or continuously curved shields.

The shield apparatus 900 includes a middle section 902, a left wing 904, a right wing 906, handles 908, and three omnidirectional electric motorized assemblies 910. Each of the omnidirectional electric motorized assemblies 910 includes a housing 912, an electric motor 914, and roller members 916. Of course, the shield 900 may include spikes or any of the spike deployment systems set forth above. The shield 900 also includes a power supply 918, a processing unit 920, a display device 922, cameras 924, and non-lethal electroshock units 926. The shield 900 also include at least one wireless transmitter and receiver 928, at least one microphone 930, and at least one speaker 932. The power supply 918 supplies power to the electric motors 914, the processing unit 920, the display device 922, the cameras 924, the non-lethal electroshock 926, the at least one wireless transmitter and receiver 928, the at least one microphone 930, and the at least one speaker 932 via wires 934. The processing unit 920 is in communication with the electric motors 914, the processing unit 920, the display device 922, the cameras 924, the non-lethal electroshock 926, the at least one wireless transmitter and receiver 928, the at least one microphone 930, and the at least one speaker 932 via wires 936, but the processing unit 920 may be in wireless communication with these components. Of course, it should be recognized that this embodiment may also to remote controlled. The omnidirectional electric motorized assemblies 910 are also equipped with sensor to determine the direction the shield is being moved. The omnidirectional electric motorized assemblies 910 may configured to assist in moving instead of performing all of the moving of the shields. Thus, the omnidirectional electric motorized assemblies may be also slipping of the electric motors.

Shield Constructs

FIGS. 10A-D depict front plan and rear plan views of single layer and multilayer ballistic shield constructs, 1000, 1030, 1050, and 1070. Looking at FIG. 10A, the single layer construct 1000 includes a single ballistic layer 1002 constructed out of a material such as metal sufficient to repel or stop a bullet fired from a fire arm.

Figures 10A, 10B, 10C, 10D:
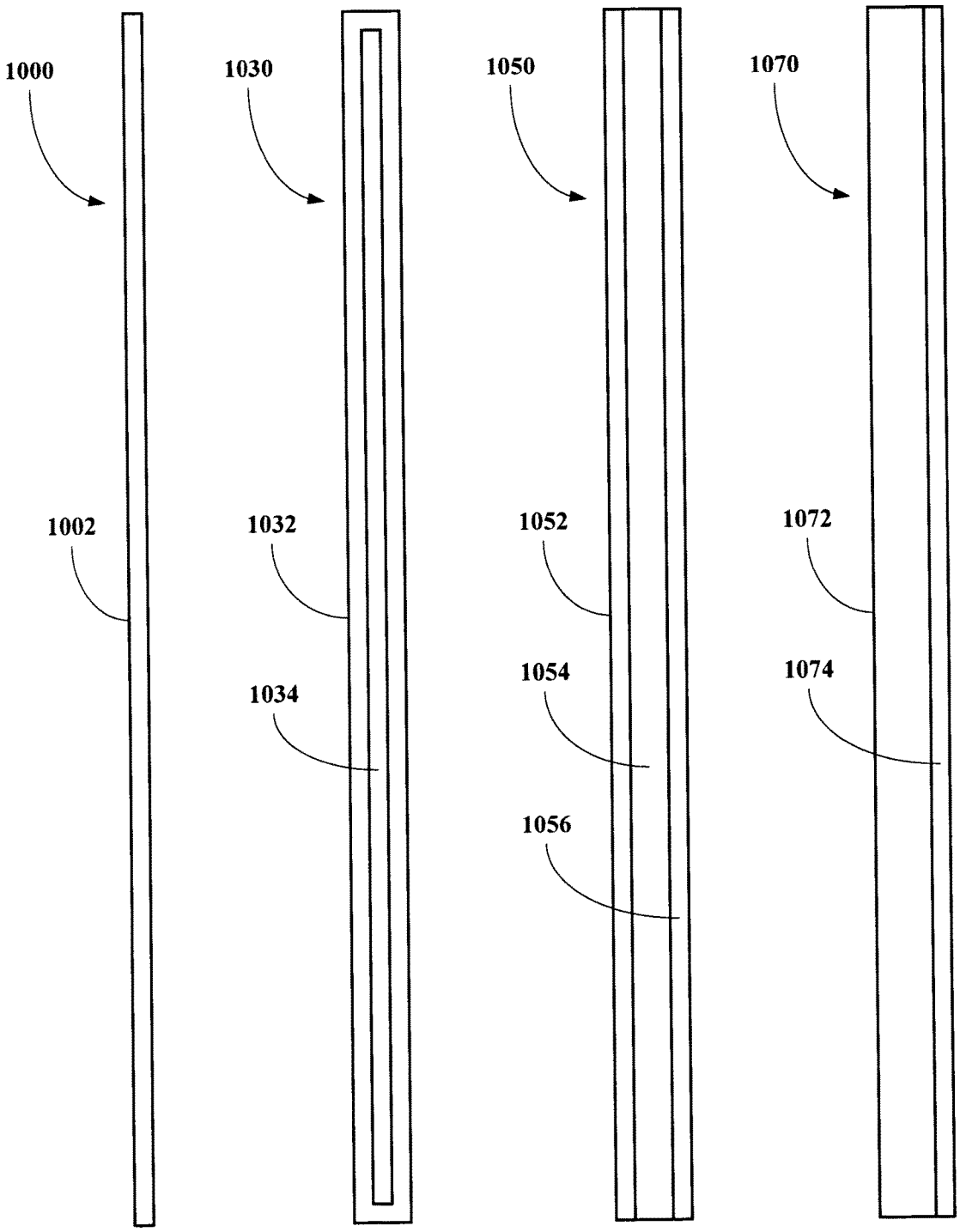

Looking at FIG. 10B, the multilayer shield construct 1030 includes an outer layer 1032 comprising a ballistic material and an interior layer 1034, which may be air or other gas or any type of ballistic material, wherein the interior layer 1034 is surrounded by the outer layer 1032. The layers 1032 and 1034 have thicknesses and compositions sufficient to repel or stop a bullet fired from a fire arm.

Looking at FIG. 10C, the multilayer shield construct 1050 includes a first outer layer 1052 comprising a ballistic material, an inner layer 1054, and a second outer layer 1056. The first outer layer 1052 may comprises a ballistic material that slows a bullet, while the inner layer 1054 may comprise a material to absorb the projectiles energy and trap the projectile in the layer 1054 and the second outer layer 1056 is composed of a material to stop the projectile if it penetrates the first outer layer 1052 and the inner layer 1056. Again, the layers 1052, 1054, and 1056 have thicknesses and compositions sufficient to repel and/or stop a bullet fired from a fire arm.

Looking at FIG. 10D, the multilayer shield construct 1070 includes an outer layer 1072 comprising a material to absorb a projectile's energy and trap the projectile in the layer 1072 and an outer layer 1074 comprising a ballistic material sufficient to repel and/or stop projectile. Again, the layers 1072 and 1074 have thicknesses and compositions sufficient to repel and/or stop a bullet fired from a fire arm and the layer 1072 has a thickness and a composition sufficient to absorb and trap 90% to 100% of projectiles penetrating the layer within the layer.

Of course, it should be recognized that the shields may be constructed of more layer, where each layer may be a different material or some of the layer may be the same material separated by different materials. The shields may also be constructed of in such a way as the material continuously changes compositions and properties form an inner surface to an outer surface. Thus, the outer surface may comprise a soft energy absorbing material and transition to a hard projectile repellant material at its inner surface.

Methods of Using the Electronic Shields

FIG. 11 depict a schematic flow chart of an embodiment of a method of this disclosure, generally 1100, is shown to include the following steps, which may be ordered differently provided that the method accomplishes the desired task. The method 1100 begins with a receive an emergency code step 1102, where a shield of this disclosure equipped with a processing unit and a display such as the shields disclosed in FIGS. 3A&B and FIG. 9 herein. The emergency code may be transmitted from a facility or from law enforcement or other emergency services.

Once the emergency code is received by the shield, the method 1100 activates the shield in an activate shield step 1104. The activation step 1104 includes activating inter-shield communication in an activate inter-shield communication step 1106. The activation step 1104 also includes activating facility communication in an activate facility communication 1108 and an active law enforcement communication in an activate law enforcement communication step 1110.

Once all of the communication links have been activated and established, the method 1100 may include the step of deploying the spikes in a deploy spikes step 1112, which may be a manual deployment or an electronic deployment depending on the nature of the shield. Additionally, the deploy spikes step 1112 may occur at any time depending on situation. It is depicted here as it is part of the activation steps.

After activation and potential spike deployment, the method 1100 includes configuring the processing unit to receive data. The first receive step involves receiving data from shield sensors such as cameras, motion sensors, thermal sensors, IR sensors, etc. in a receive shield sensor data step 1114. The method 1100 also includes receiving other shield data in a receive other shield data step 1116. The method 1100 also includes receiving facility data in a receive facility data step 1118. The method 1100 also includes receiving law enforcement data in a receive law enforcement data step 1120. It should be recognized that the method 1100 may receive data from any, some or all of these sources on a continuous, periodic, semi-periodic, and/or intermittent basis for the duration of an emergency situation.

After receipt of any, some or all of the data, the method 1100 also include configuring the processing unit to send the data in a readable or image-based format to the display device. The method 1100 may include displaying the sensor data in a sensor data window on the display in display sensor data step 1122. Because the method 1100 is long, FIG. 11 is split into two figures with a circle A representing a path from the second page of FIG. 11 to the first page of FIG. 11 and a circle B representing a path from the first page of FIG. 11 to the second page of FIG. 11 The method 1100 includes displaying the other shield data in a other shield data window on the display in display other shield data step 1124 as a continuation through the circle B. The method 1100 includes displaying the facility data in a facility data window on the display in display facility data step 1126. The method 1100 includes displaying the law enforcement data in a facility data window on the display in display law enforcement data step 1128.

The method 1100 also includes configuring the processing unit to process the data, any, some or all of the data, to determine an optimal location for the shield from both an offensive and defensive perspective in a determine optimal offensive and/or defensive shield location step 1130.

The method 1100 also includes configuring the processing unit to communicate with other shields in a communication with other shields step 1132. The method 1100 also includes configuring the processing unit to communicate with facility personnel in a communication with facility personnel step 1134. The method 1100 also includes configuring the processing unit to communicate with law enforcement in a communication with law enforcement step 1136.

The method 1100 also includes configuring the processing unit to coordinate shield movement with law enforcement and/or other shields based on the dynamics of the situation in a coordinate shield movement step 1138.

The method 1100 also includes configuring the processing unit to determine whether the situation is ongoing in an ongoing conditional step 1140. The determination may be the receipt of a stand down order from law enforcement, from facility personnel or from other data. If the situation is ongoing, then control is transferred along a YES branch through the circle A to receive shield sensor data step 1114. If the situation is not ongoing or has been resolved, the control is transferred along a NO branch to a retract spikes and reposition shield step 1142. The method 1100 then includes the step of deactivating the shield in a deactivate shield step 1144.

Closing Paragraph of the Disclosure

All references cited herein are incorporated by reference. Although the disclosure has been disclosed with reference to its preferred embodiments, from reading this description those of skill in the art may appreciate changes and modification that may be made which do not depart from the scope and spirit of the disclosure as described above and claimed hereafter.

We claim:

1. A movable ballistic shield apparatus comprising:

a body including a middle section, a forward facing left wing, and a forward facing right wing so that the body has a convex configuration when viewed from a back of the body, a plurality of handles disposed on or in a back surface of the middle section, or on or in the back surface of the middle section and on or in a back surface of each of the wings, and at least three omnidirectional roller assemblies disposed on a bottom of the middle section and the wings so that the shield stands upright, and a monitoring assembly, wherein the middle section and wings comprise a ballistic material capable of slowing, trapping, stopping, and/or deflecting a bullet.

2. The apparatus of claim 1, wherein:

the middle section and the wings are straight and each of the wings makes an angle relative to the middle section, or the middle section is straight and the wings are curved, or the middle section and the wings form a continuous convex surface when viewed from the back of the body.

3. The apparatus of claim 1, wherein the monitoring assembly includes at least one transparent member disposed in the middle section, wherein the transparent member comprises a transparent ballistic material.

4. The apparatus of claim 1, wherein:

the monitoring assembly includes a power supply, a processing unit, a display device, cameras, sensors, at least one non-lethal electroshock unit, at least one wireless transmitter and receiver, at least one microphone, and at least one speaker, the power supply provides power to the other components via wires, and the processing unit communications and controls the other components via wires or via wireless communication.

5. The apparatus of claim 4, further comprising:

a plurality of spikes or a plurality automatic spike deployment assemblies:

each of the automatic spike deployment assemblies includes a solenoid and a spike, and the middle section includes a plurality of apertures through which the spikes traverse in transitioning between a retracted state and a deployed state, wherein the solenoids are powered by the power supply and controlled by the processing unit.

6. The apparatus of claim 4, further comprising:

a plurality of spikes or a plurality automatic spike deployment assemblies:

each of the automatic spike deployment assemblies includes a worm drive and a threaded spike, and the middle section includes a plurality of apertures through which the spikes traverse in transitioning between a retracted state and a deployed state, wherein the worm drives are powered by the power supply and controlled by the processing unit.

7. The apparatus of claim 4, wherein the omnidirectional roller assemblies are motorized, wherein the motorized roller assemblies are powered by the power supply and controlled by the processing unit.

8. The apparatus of claim 4, wherein:

the wings, the spikes, and the at least one non-lethal electroshock unit provide an offensive capability of the apparatus, and the middle section, the wings, and the monitoring assembly provide a defensive capability of the apparatus.

9. The apparatus of claim 1, further comprising:

a plurality of spikes or a plurality of manual spike deployment assemblies.

10. The apparatus of claim 9, wherein:

each of the manual spike deployment assemblies includes a lever arm and a spike deployment arm including a plurality of spikes, and the middle section includes a plurality of apertures through which the spikes traverse in transitioning between a retracted state and a deployed state.

11. The apparatus of claim 9, wherein:

each of the manual spike deployment assemblies includes a spike, a spring, a stop, and a release key pin, and the middle section includes a plurality of apertures through which the spikes traverse in transitioning between a retracted state and a deployed state.

12. The apparatus of claim 1, wherein the body further includes a backward facing left wing and a backward facing right wing, wherein the backward facing left wing and the backward facing right wing comprise a ballistic material.

13. The apparatus of claim 1, wherein the convex configuration is configured to focus bullet ricochets in a direction of the shots striking the front surface of the apparatus.

14. A movable ballistic shield apparatus comprising:

a body including a middle section, a forward facing left wing, and a forward facing right wing so that the body has a convex configuration when viewed from a back of the body, a plurality of automatic spike deployment assemblies, a plurality of handles disposed on or in a back surface of the middle section or on or in the back surface of the middle section and on or in a back surface of each of the wings, at least three omnidirectional roller assemblies disposed on a bottom of the middle section and the wings so that the shield stands upright, and a monitoring assembly including a power supply, a processing unit, a display device, cameras, sensors, at least one non-lethal electroshock unit, at least one wireless transmitter and receiver, at least one microphone, and at least one speaker, wherein the power supply provides power to the other components via wires and the processing unit communications and controls the other components via wires or via wireless communication, wherein the middle and wings comprise a ballistic material capable of slowing, trapping, stopping and/or deflecting a bullet.

15. The apparatus of claim 14, wherein:

each of the automatic spike deployment assemblies includes a solenoid and a spike, and the middle section includes a plurality of apertures through which the spikes traverse in transitioning between a retracted state and a deployed state, wherein the solenoids are powered by the power supply and controlled by the processing unit.

16. The apparatus of claim 14, wherein:

each of the automatic spike deployment assemblies includes a worm drive and a threaded spike, and the middle section includes a plurality of apertures through which the spikes traverse in transitioning between a retracted state and a deployed state, wherein the worm drives are powered by the power supply and controlled by the processing unit.

17. The apparatus of claim 14, wherein the omnidirectional roller assemblies are either manual or motorized, wherein the motorized roller assemblies are powered by the power supply and controlled by the processing unit.

18. The apparatus of claim 14, wherein:

the wings, the spikes, and the one non-lethal electroshock unit provide an offensive capability of the apparatus, and the middle section, the wings, the monitoring assembly provide a defensive capability of the apparatus.

19. The apparatus of claim 14, wherein the convex configuration is configured to focus bullet ricochets in a direction of the shots striking the front surface of the apparatus.

20. The apparatus of claim 14, wherein:

the middle section and the wings are straight and each of the wings makes an angle relative to the middle section, or the middle section is straight and the wings are curved, or the middle section and the wings form a continuous convex surface when viewed from the back of the body.

21. A method of using electronic shields comprising:

providing a shield comprising:

a body including:

a middle section, a forward facing left wing, and a forward facing right wing configured to have a convex configuration when viewed from a back of the body, a plurality of spikes or spike deployment assemblies, a plurality of handles disposed in or on a back surface of the middle section or in or on the back surface of the middle section and back surfaces of the wings, at least three omnidirectional roller assemblies, and a monitoring assembly including:

a power supply, a processing unit, a display device, cameras, sensors, at least one non-lethal electroshock unit, at least one wireless transmitter and receiver, at least one microphone, and at least one speaker, wherein the power supply provides power to the other components via wires, and wherein the processing unit communications and controls the other components via wires or via wireless communication, and wherein the middle and wings are constructed out of a ballistic material capable of slowing, trapping, stopping, and/or deflecting a bullet;

receiving an emergency code transmitted from a facility or from law enforcement or other emergency services via the at least one wireless transmitter and receiver;

activating one or a plurality of shields;

activating inter-shield communication;

activating facility communication;

activating law enforcement communication;

deploying the spikes;

receiving data, via the processing unit, from the shield cameras and sensors, from the other shields, from the facility, and law enforcement on a continuous, a periodic, a semi-periodic, and/or an intermittent basis for the duration of the emergency situation;

sending the data, via the processing unit, to the display device;

displaying the sensor data in a sensor data window on the display device;

displaying the other shield data in an other shield data window on the display device;

displaying the facility data in a facility data window on the display device;

displaying the law enforcement data in a law enforcement data window on the display device;

determining, via the processing unit, from any, some, or all of the data an optimal location for the shield or shields from both an offensive and defensive perspective;

communicating, via the processing unit, with the other shields, facility personnel, and law enforcement;

coordinating, via the processing unit, shield movement with law enforcement and/or other shields based on a dynamics of the emergency situation; and repeating the receiving, sending, displaying, determining, communicating, and coordinating steps until the emergency situation is over.

* * * * *